US005278033A

United States Patent [19]

Hagiwara et al.

[11] Patent Number: 5,278,033

[45] Date of Patent: Jan. 11, 1994

[54] STABILIZING SOLUTION FOR LIGHT-SENSITIVE SILVER HALIDE COLOR PHOTOGRAPHIC MATERIAL, AND PROCESSING METHOD MAKING USE OF THE STABILIZING SOLUTION

[75] Inventors: Moeko Hagiwara; Ichiro Tsuchiya; Tsuyoshi Haraguchi, all of Hino, Japan

[73] Assignee: Konica Corporation, Tokyo, Japan

[21] Appl. No.: 855,725

[22] Filed: Mar. 20, 1992

[30] Foreign Application Priority Data

Mar. 28, 1991 [JP] Japan ..... 3-089686

[51] Int. Cl.[5] ..... G03C 5/39

[52] U.S. Cl. ..... 430/429; 430/428; 430/463; 430/401; 430/449

[58] Field of Search ..... 430/428, 429, 463, 401, 430/449

[56] References Cited

U.S. PATENT DOCUMENTS

| | | | |
|---|---|---|---|
| 3,676,136 | 7/1972 | Mowrey | 430/449 |
| 4,778,748 | 10/1988 | Kuse et al. | 430/428 |
| 4,855,217 | 8/1989 | Kurematsu et al. | 430/463 |

FOREIGN PATENT DOCUMENTS

| | | |
|---|---|---|
| 217643 | 4/1987 | European Pat. Off. . |
| 47-18333 | 9/1972 | Japan . |
| 49-62128 | 6/1974 | Japan . |
| 51-17114 | 2/1976 | Japan . |
| 51-37538 | 10/1976 | Japan . |
| 52-73037 | 6/1977 | Japan . |
| 53-28426 | 3/1978 | Japan . |
| 53-95630 | 8/1978 | Japan . |
| 55-51172 | 12/1980 | Japan . |
| 60-17445 | 1/1985 | Japan . |
| 60-240153 | 11/1985 | Japan . |
| 61-28949 | 2/1986 | Japan . |
| 61-151538 | 7/1986 | Japan . |
| 62-27742 | 2/1987 | Japan . |
| 62-123459 | 6/1987 | Japan . |
| 62-254151 | 11/1987 | Japan . |
| 1-206343 | 8/1989 | Japan . |
| 1-222259 | 9/1989 | Japan . |
| 1-295258 | 11/1989 | Japan . |
| 2-43546 | 2/1990 | Japan . |
| 2-234776 | 9/1990 | Japan . |
| 2-44347 | 12/1990 | Japan . |
| 3-182750 | 8/1991 | Japan . |
| 651059 | 3/1951 | United Kingdom . |
| 1281619 | 7/1972 | United Kingdom . |
| 1365453 | 9/1974 | United Kingdom . |
| 1392134 | 4/1975 | United Kingdom . |
| 2181856 | 4/1987 | United Kingdom . |

*Primary Examiner*—Charles L. Bowers, Jr.
*Assistant Examiner*—Mark F. Huff
*Attorney, Agent, or Firm*—Frishauf, Holtz, Goodman & Woodward

[57] ABSTRACT

Disclosed is a stabilizing solution for a light-sensitive silver halide color photographic material, comprises a compound represented by the following Formula I, and has a surface tension of from 15 to 60 dyne/cm at 20° C.;

Formula I:

wherein Z represents a group of atoms necessary to form a substituted or unsubstituted cyclic hydrocarbon or heterocyclic ring, X represents an aldehyde group, wherein $R_1$ and $R_2$ each represent a lower alkyl group. The stabilizing solution and the processing method for a light-sensitive silver halide color photographic material according to this invention, can provide a processing technique that can achieve a superior stability of dye images, can better prevent backside deposits, can promise superior solution stability, and can better prevent yellow staining.

12 Claims, No Drawings

STABILIZING SOLUTION FOR LIGHT-SENSITIVE SILVER HALIDE COLOR PHOTOGRAPHIC MATERIAL, AND PROCESSING METHOD MAKING USE OF THE STABILIZING SOLUTION

FIELD OF THE INVENTION

The present invention relates to a stabilizing solution for light-sensitive silver halide color photographic materials, and a processing method making use of the stabilizing solution. More particularly, it is concerned with a processing technique that can achieve a superior stability of dye images, can better prevent backside deposits, can promise superior solution stability, and can better prevent yellow staining.

BACKGROUND OF THE INVENTION

In the processing of light-sensitive color photographic materials for photographing as typified by light-sensitive photographic materials in which the silver halide comprises silver iodobromide, it has been hitherto common to use in a final processing step subsequent to a washing bath a stabilizing solution containing formaldehyde.

The formaldehyde used in the above stabilizing solution is effective for preventing changes in physical properties of light-sensitive color photographic materials, in particular, changes in gradation that may occur when scratches are produced on the surfaces of light-sensitive color photographic materials or light-sensitive photographic materials are gradually hardened with time. The formaldehyde is also known to be effective against the deterioration of dye images that may be caused by an unreacted coupler remaining in light-sensitive color photographic materials.

However, the formaldehyde added in the stabilizing solution for the purpose of, e.g., stabilizing dye images may form an adduct together with sulfite ions that adhere to a light-sensitive material and are brought into it from a forebath (a processing solution having a fixing ability), not only resulting in a decrease in the originally intended dye image stabilizing effect, but also causing a promotion of sulfiding disadvantageously.

To solve these problems, it has been proposed to use an alkanol amine as disclosed in U.S. Pat. No. 4,786,583. Use of the alkanol amine, however, tends to have an ill influence to the prevention of yellow staining at a non-image portion, and also can not be said to bring about a satisfactory effect for the prevention of sulfiding.

Meanwhile, in U.S.A., CIIT (Chemical Industry Institute of Toxicology) has reported that formaldehyde caused nasal foramen cancer in rats as a result of administration of 15 ppm of formaldehyde. NIOSH (National Institute for Occupational Safety and Health) and ACGIH (American Conference of Governmental Industrial Hygienists) also state that there is a possibility of producing a cancer. In Europe also, use of formaldehyde is strongly regulated. In West Germany, formaldehyde has been so regulated since 10 years ago as to be in a concentration of 0.1 ppm or less in residential areas.

In Japan also, in token of the harmfulness of formaldehyde, there have been legislations concerning poisons and powerful drugs because of its stimulative action to the mucous membrane, regulations to organic solvent toxication, according to the Specified Chemical Substances Troubles Preventive Rule of the Occupational Safety and Health Law, regulations on household utensils, regulations relating to fibers and veneer boards, and also formaldehyde regulations put into operation as from 1975 with regard to undershirts and baby's clothing. Thus, people have longed for a technique by which the formaldehyde can be decreased.

As techniques of making substantially zero, or decreasing, the content of formaldehyde in stabilizing solutions, Japanese Patent Publications Open to Public Inspection [hereinafter referred to as Japanese Patent O.P.I. Publication(s)] No. 27742/1987 and No. 151538/1986 disclose use of hexahydrotriazine compounds and U.S. Pat. No. 4,859,574 discloses use of N-methylol compounds, as means for achieving the above objects.

The hexahydrotriazine compounds can prevent dyes from being discolored in an environment of high temperature and high humidity even if formaldehyde has been made substantially zero, but have the problem that they are not effective in an environment of low humidity, e.g., a relative humidity of 20% or less. They have also the problem that back-side deposits tend to be produced because of uneven run-down or the like of a stabilizing solution on the back of a light-sensitive color photographic material for photographing. They have still also have a problem in the storage stability of stabilizing solutions although not so serious as formaldehyde, in particular, the problem that the sulfiding tends to occur. It has been made clear that the storage stability is particularly questioned when a stabilizing solution is used in processing over a long period of time, when used in processing in a small quantity, or when used in a low replenishing rate.

As for the N-methylol compounds, when used as substitute compounds of formaldehyde, they have the problems that the effect of preventing discoloration of dyes, the prevention of back-side deposits and the storage stability of stabilizing solutions can not be satisfactory and that an attempt to prevent discoloration of dyes results in a great deterioration of the storage stability of stabilizing solutions.

There is also a disclosure of a method in which hexamethylenetetramine compounds are used in stabilizing solutions, which, however, similar to the hexahydrotriazine compounds, are disadvantageous in that they have a weak effect of preventing discoloration of dyes in an environment of low humidity.

SUMMARY OF THE INVENTION

Accordingly, an object of the present invention is to provide a stabilizing solution for light-sensitive silver halide color photographic materials that firstly can prevent discoloration of dyes in an environment of low humidity even when substantially no formaldehyde is contained in the stabilizing solution, secondly can better prevent back-side deposits on light-sensitive materials, thirdly have a superior storage stability and, in particular, can supply a processing solution wherein no sulfiding tends to occur, fourthly can better prevent yellow staining at non-image portions, and fifthly can improve the safety of work environments, and a processing method making use of such a stabilizing solution.

To achieve the above object, the present inventors made extensive studies, and as a result have accomplished the present invention.

The stabilizing solution for a light-sensitive silver halide color photographic material according to the present invention comprises a compound represented by the following Formula I, and has a surface tension of from 15 to 60 dyne/cm at 20° C.

Formula I:

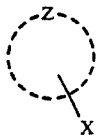

wherein Z represents a group of atoms necessary to complete a substituted or unsubstituted cyclic hydrocarbon or heterocyclic ring; and X represents an aldehyde group,

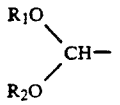

or

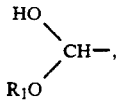

wherein $R_1$ and $R_2$ each represent a lower alkyl group. The method of processing a light-sensitive silver halide color photographic material according to the present invention comprises processing a light-sensitive silver halide color photographic material by the use of at least one of a processing solution having a bleaching ability and a processing solution having a fixing ability, and thereafter processing it by the use of the stabilizing solution described above.

As a preferred embodiment of the present invention, in the above stabilizing solution for a light-sensitive silver halide color photographic material and the above processing method, the above Z in Formula I represents an aromatic hydrocarbon ring or heterocyclic ring having a substituent; the stabilizing solution may contain substantially no formaldehyde; the stabilizing solution may contain a water-soluble surface active agent; and/or the stabilizing solution may contain an antifungal agent.

As another preferred embodiment of the present invention, the substitutent of the above Z is an aldehyde group, a hydroxyl group, an alkyl group, an aralkyl group, an alkoxyl group, a halogen atom, a nitro group, a sulfo group, a carboxyl group, an amino group, a hydroxyalkyl group, an aryl group, a cyano group, an aryloxy group, an acyloxy group, an acylamino group, a sulfonamide group, a sulfamoyl group, a carbamoyl group or a sulfonyl group.

DETAILED DESCRIPTION OF THE INVENTION

Processing steps in the processing method making use of the stabilizing solution of the present invention may include the following, which are by no means limited to these.

(1) Color developing→bleach-fixing→washing→stabilizing
(2) Color developing→bleaching→fixing→washing→stabilizing
(3) Color developing→bleaching→bleach-fixing→washing →stabilizing
(4) Color developing→bleach-fixing→fixing→washing→stabilizing
(5) Color developing→bleach-fixing→bleach-fixing→washing→stabilizing
(6) Color developing→fixing→bleach-fixing→washing→stabilizing
(7) Color developing→bleaching→bleach-fixing→fixing →washing→stabilizing
(8) Black and white developing→washing→reversal→color developing→washing→compensating→bleaching→fixing→washing→stabilizing
(9) Black and white developing→washing→reversal→color developing→washing→compensating→bleach-fixing→ washing→stabilizing
(10) Color developing→bleach-fixing→stabilizing
(11) Color developing→bleaching→fixing→stabilizing
(12) Color developing→bleaching→bleach-fixing→stabilizing
(13) Color developing→bleach-fixing→fixing→stabilizing
(14) Color developing→bleach-fixing→bleach-fixing→stabilizing
(15) Color developing→fixing→bleach-fixing→stabilizing
(16) Color developing→bleaching→bleach-fixing→fixing →stabilizing
(17) Black and white developing→washing→reversal→color developing→washing→compensating→bleaching→fixing→stabilizing
(18) Black and white developing→washing→reversal→color developing→washing→compensating→bleach-fixing→stabilizing In the present invention, the processing steps may preferably be those of (1), (2), (8), (10), (11) and (17), more preferably those of (2), (8), (11) and (17), and particularly preferably those of (11).

In other words, a most preferred embodiment of the processing method in the present invention is a method in which after processing with a processing solution having a bleaching ability and/or a processing solution having a fixing ability, preferably after processing with a processing solution having a fixing ability, processing with the stabilizing solution is immediately carried out. In the present invention, the processing solution having a bleaching ability refers to, for example, a bleaching solution or a bleach-fixing solution in the above processing steps. The processing solution having a fixing ability also refers to, for example, a fixing solution or a bleach-fixing solution.

The compound represented by Formula I used in the present invention will be detailed below.

In Formula I, Z represents a group of atoms necessary to complete a substituted or unsubstituted carbon ring or heterocyclic ring. The carbon ring and the heterocyclic ring may each be a single ring or a condensed ring. Z may preferably be an aromatic carbon ring or heterocyclic ring having a substituent. The substituent on Z may preferably be an aldehyde group, a hydroxyl group, an alkyl group as exemplified by methyl, ethyl, methoxyethyl, benzyl, carboxymethyl or sulfopropyl, an aralkyl group, an alkoxy group as exemplified by methoxy, ethoxy or methoxy ethoxy, a halogen atom, a nitro group, a sulfo group, a carboxyl group, an amino group as exemplified by N,N-dimethylamino, N-ethylamino or N-phenylamino, a hydroxyalkyl group, an aryl group as exemplified by phenyl or p-methoxyphenyl, a cyano group, an aryloxy group as exemplified by phenoxy or p-carboxyphenyl, an acyloxy group, an acylamino group, a sulfonamide group, a sulfamoyl group as exemplified by N-ethylsulfamoyl or N,N-dimethylsulfamoyl, a carbamoyl group as exemplified by carbamoyl, N-methylcarbamoyl or N,N-tetramethylenecarbamoyl, or a sulfonyl group as exemplified by methanesulfonyl, ethanesulfonyl, benzenesulfonyl or p-toluenesulfonyl.

The carbon ring represented by Z may preferably be a benzene ring. The heterocyclic ring represented by Z may preferably include heterocyclic rings of 5 or 6 members. The rings of 5 members are exemplified by thienyl, pyrolyl furyl, thiazolyl, imidazolyl, pyrazolyl, succinimide, triazolyl or tetrazolyl. The rings of 6 members are exemplified by pyridyl, pyrimidinyl, triaziynyl or thiadiazinyl. The condensed ring may include naphthalene, benzofuran, indol, thionaphthalene, benzoimidazolyl, benzotriazolyl and quinolyl.

Exemplary compounds of the compound represented by Formula I are shown below.

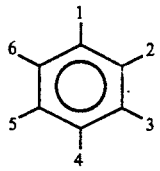

Structural formulas of Exemplary compounds 1 to 48 are each completed by inserting the following substituents or atoms 1 to 6 to the positions 1 to 6 of the above formula.

| No. | 1 | 2 | 3 | 4 | 5 | 6 |
|---|---|---|---|---|---|---|
| (1) | CHO | H | H | H | H | H |
| (2) | CHO | H | H | OH | H | H |
| (3) | CHO | H | OH | H | H | H |
| (4) | CHO | OH | H | H | H | H |
| (5) | CHO | OH | H | OH | H | H |
| (6) | CHO | H | OH | H | OH | H |
| (7) | CHO | OH | OH | H | H | H |
| (8) | CHO | H | CHO | H | OH | H |
| (9) | CHO | H | CHO | H | H | OH |
| (10) | CHO | OH | CHO | H | H | H |
| (11) | CHO | H | CHO | H | CHO | H |
| (12) | CHO | OH | CHO | H | CHO | H |
| (13) | $CH(OCH_3)_2$ | H | OH | H | H | H |
| (14) | $CH(OCH_3)_2$ | H | H | OH | H | H |
| (15) | $CH(OCH_3)_2$ | H | OH | H | OH | H |
| (16) | CHO | H | $NO_2$ | H | H | H |
| (17) | CHO | H | H | $NO_2$ | H | H |
| (18) | CHO | $NO_2$ | H | H | H | H |
| (19) | CHO | H | $NO_2$ | H | $NO_2$ | H |
| (20) | CHO | H | H | $OCH_3$ | H | H |
| (21) | CHO | H | $OCH_3$ | H | OH | H |
| (22) | CHO | H | OH | $OCH_3$ | H | H |
| (23) | CHO | H | $OCH_3$ | OH | H | H |
| (24) | CHO | H | OH | $OCH_3$ | OH | H |
| (25) | CHO | H | Cl | H | H | H |
| (26) | CHO | H | H | Cl | H | H |
| (27) | CHO | H | Cl | H | Cl | H |
| (28) | CHO | H | COOH | COOH | H | H |
| (29) | CHO | H | Br | H | H | H |
| (30) | CHO | H | H | Br | H | H |
| (31) | CHO | H | OH | $SO_3H$ | H | H |
| (32) | CHO | H | H | $NH_2$ | H | H |
| (33) | CHO | H | H | $N(CH_3)_2$ | H | H |
| (34) | CHO | H | H | $N(C_2H_5)_2$ | H | H |
| (35) | CHO | H | H | $CONH_2$ | H | H |
| (36) | CHO | H | H | $SO_2NH_2$ | H | H |
| (37) | CHO | H | H | $SO_3H$ | H | H |
| (38) | CHO | H | H | CN | H | H |
| (39) | CHO | H | H | $COOCH_3$ | H | H |
| (40) | CHO | H | H | COOH | H | H |
| (41) | CHO | H | $SO_3H$ | H | H | H |
| (42) | CHO | H | COOH | H | H | H |
| (43) | CHO | H | CN | H | H | H |
| (44) | CHO | H | $COOCH_3$ | H | H | H |
| (45) | CHO | H | $CONH_2$ | H | H | H |
| (46) | $CH<^{OH}_{OCH_3}$ | H | OH | H | H | H |
| (47) | $CH<^{OH}_{OCH_3}$ | H | H | OH | H | H |
| (48) | CHO | H | OH | $CH_3$ | H | H |

-continued
(49)
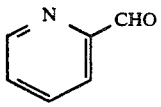
(50)
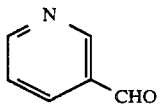
(51)
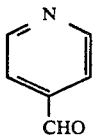
(52)
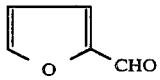
(53)
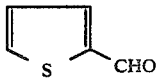
(54)
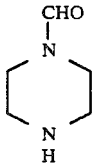
(55)
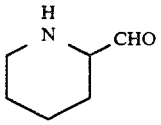
(56)
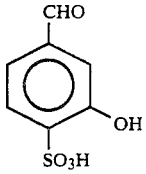
(57)
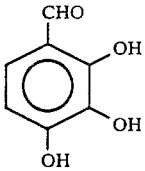
(58)
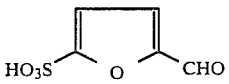
(59)
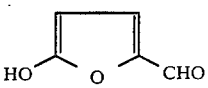
(60)
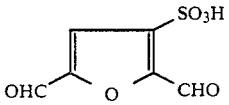
(61)
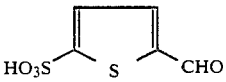
(62)
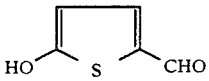
(63)
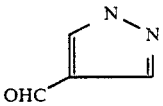
(64)
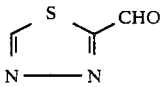
(65)
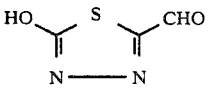
(66)
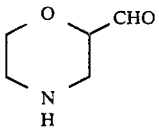
(67)
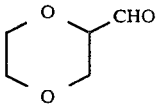
(68)
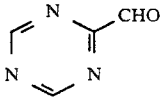
(69)
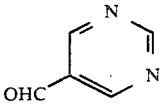
(70)
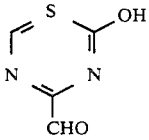

-continued
(71) 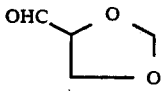
(72) 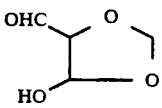
(73) 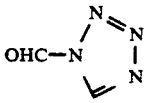
(74) 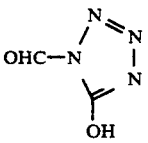
(75) 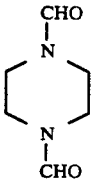
(76) 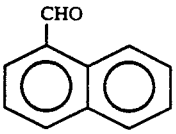
(77) 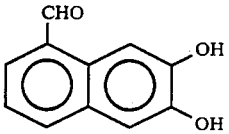
(78) 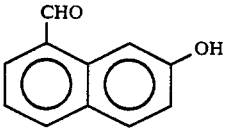
(79) 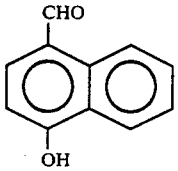
(80) 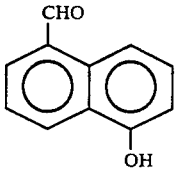
(81) 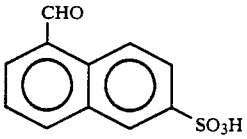
(82) 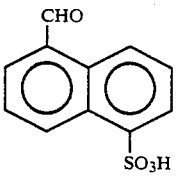
(83) 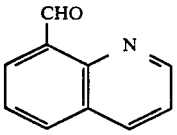
(84) 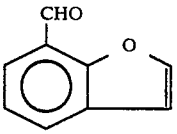
(85) 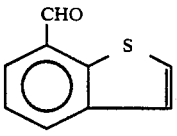
(86) 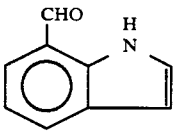
(87) 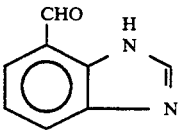
(88) 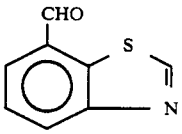
(89) 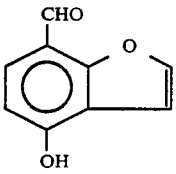
(90) 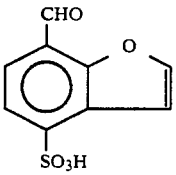
The compound represented by Formula I is readily commercially available.
The compound represented by Formula I is contained in the stabilizing solution for light-sensitive silver halide color photographic materials. It may also be contained in i) a processing solution used in a forebath of the processing bath having a bleaching ability, ii) the processing solution having a bleaching ability and iii) the processing solution having a fixing ability, so long as the effect of the present invention is not damaged.

The compound represented by Formula I may preferably be added in an amount of from 0.05 to 20 g, more preferably from 0.1 to 15 g, and particularly preferably from 0.5 to 10 g, per liter of the stabilizing solution.

The compound represented by Formula I is characterized by giving a good image storage stability particularly in an environment of low humidity, compared with any known formaldehyde substitute compounds.

In the present invention, the surface tension of the stabilizing solution can be measured by the commonly available measuring method as described in Fumio Kitahara, Shigeo Hayano and Ichiro Hara, "KAIMEN-DASSEIZAI NO BUNSEKI TO SHIKEN HOHO (Analyses of Surfactants and Test Methods)", published Mar. 1, 1982 by Kodansha Co. In the present invention, it is a value of surface tension measured by the usual commonly available method at 20° C.

In the stabilizing solution, any compounds capable of giving a surface tension of from 15 to 60 dyne/cm, and preferably from 15 to 45 dyne/cm, at 20° C. can be used. In particular, the stabilizing solution may preferably contain a water-soluble surface active agent. As the water-soluble surface active agent, at least one compound selected from a compound represented by the following Formula SI, a compound represented by the following SII and a water-soluble organic siloxane compound may particularly preferably be used in view of their effect for what is aimed in the present invention.

$$R^1—X—(E^1—)_{l1}—(—E^2—)_{m1}—(—E^3—)_{n1}—R^2 \quad \text{Formula SI}$$

wherein $R^1$ represents a hydrogen atom, an aliphatic group or an acyl group; $R^2$ represents a hydrogen atom or an aliphatic group; $E^1$ represents ethylene oxide, $E^2$, propylene oxide, and $E^3$, ethylene oxide; and X represents an oxygen atom or an $—R^3N—$ group, wherein $R^3$ represents an aliphatic group, a hydrogen atom or $(E^1—)_{l2}—(—E^2—)_{m2}—(—E^3—)_{n2}—R^4$, wherein $R^4$ represents a hydrogen atom or an aliphatic group. 11, 12, m1, m2, n1, n2 each represent a value of 0 to 300.

$$A_2—O—(B—)_m—(—C—)_n—X_1 \quad \text{Formula SII}$$

wherein $A_2$ represents a monovalent organic group as exemplified by an alkyl group having 6 to 50 carbon atoms, and preferably 6 to 35 carbon atoms, including groups such as hexyl, heptyl, octyl, nonyl, decyl, undecyl and dodecyl, or an aryl group substituted with an alkyl group having 3 to 35 carbon atoms or an alkenyl group having 2 to 35 carbon atoms.

The group substituted on the aryl group may preferably include an alkyl group having 1 to 18 carbon atoms as exemplified by an unsubstituted alkyl group such as methyl, propyl, butyl, pentyl, hexyl, heptyl, octyl, nonyl, decyl, undecyl or dodecyl, a substituted alkyl group such as benzyl or phenethyl, or an alkenyl group having 2 to 20 carbon atoms as exemplified by an unsubstituted alkenyl group such as oleyl, cetyl or allyl or a substituted alkenyl group such as styryl. The aryl group may include groups such as phenyl, biphenyl and naphthyl, and preferably a phenyl group. The position of substitution on the aryl group may be any of the ortho, meta and para positions. A plurality of groups may be substituted thereon.

B and C each represent ethylene oxide, propylene oxide, or $$\left(CH_2\right)_{n1}\left(\underset{\substack{|\\OH}}{CH}\right)_{m1}\left(CH_2\right)_{l1}O,$$

wherein n1, m1 and l1 each represent 0, 1, 2 or 3; m and n each represent an integer of 0 to 100. $X_1$ represents a hydrogen atom, or an alkyl group, an aralkyl group or an aryl group, which may include the groups exemplified for those represented by $A_2$.

Examples of the compound represented by Formula SI or SII are shown below. Examples are by no means limited to these.

Compound represented by Formula SI:

$C_{12}H_{25}COO(C_2H_4O)_{10}H$ SI-1

$C_9H_{19}COO(C_2H_4O)_{14}H$ SI-2

$C_{12}H_{25}NH(C_2H_4O)_{10}H$ SI-3

$C_{12}H_{25}NH(C_2H_4O)_{15}H$ SI-4

$HO(C_2H_4O)_{20}(\underset{\substack{|\\CH_3}}{CH}CH_2O)_{75}(C_2H_4O)_{20}H$ SI-5

$C_{12}H_{25}—NHCH_2CH_2OH$ SI-6

$C_{12}H_{25}—N(CH_2CH_2O)_{10}H)(CH_2CH_2O)_{10}H)$ SI-7

$C_{12}H_{25}—N(CH_2CH_2O)_{6}H)(CH_2CH_2O)_{5}H)$ SI-8

$HO(\underset{\substack{|\\CH_3}}{CH}CH_2O)_{16.4}(CH_2CH_2O)_{21.6}H$ SI-9

$HO(\underset{\substack{|\\CH_3}}{CH}CH_2O)_{16.4}(CH_2CH_2O)_{14.4}H$ SI-10

$HO(\underset{\substack{|\\CH_3}}{CH}CH_2O)_{20.7}(CH_2CH_2O)_{18.2}H$ SI-11

$HO(\underset{\substack{|\\CH_3}}{CH}CH_2O)_{30.2}(CH_2CH_2O)_{26.5}H$ SI-12

$HO(\underset{\substack{|\\CH_3}}{CH}CH_2O)_{30.2}(CH_2CH_2O)_{39.8}H$ SI-13

$HO(\underset{\substack{|\\CH_3}}{CH}CH_2O)_{30.2}(CH_2CH_2O)_{159.1}H$ SI-14

$HO(\underset{\substack{|\\CH_3}}{CH}CH_2O)_{35.3}(CH_2CH_2O)_{48.6}H$ SI-15

$HO(\underset{\substack{|\\CH_3}}{CH}CH_2O)_{35.3}(CH_2CH_2O)_{108.7}H$ SI-16

-continued
$HO(CH(CH_3)CH_2O)_{38.8}(CH_2CH_2O)_{34.1}H$ SI-17
$HO(CH(CH_3)CH_2O)_{38.8}(CH_2CH_2O)_{51.1}H$ SI-18
$HO(CH(CH_3)CH_2O)_{38.8}(CH_2CH_2O)_{119.3}H$ SI-19
$HO(CH(CH_3)CH_2O)_{38.8}(CH_2CH_2O)_{204.5}H$ SI-20
$HO(CH(CH_3)CH_2O)_{47.4}(CH_2CH_2O)_{41.7}H$ SI-21
-continued
$HO(CH(CH_3)CH_2O)_{56.0}(CH_2CH_2O)_{31.7}H$ SI-22
$HO(CH(CH_3)CH_2O)_{56.0}(CH_2CH_2O)_{49.2}H$ SI-23
$HO(CH(CH_3)CH_2O)_{56.0}(CH_2CH_2O)_{73.9}H$ SI-24
$HO(CH(CH_3)CH_2O)_{56.0}(CH_2CH_2O)_{295.3}H$ SI-25
Compound represented by Formula SII:
$C_{12}H_{25}-O(C_2H_4O)_{10}H$ SII-1
$C_8H_{17}-O(C_3H_8O)_{15}-H$ SII-2
$C_8H_{18}-O(C_2H_4O)_{4}H$ SII-3
$C_{10}H_{21}-O(C_2H_4O)_{15}-H$ SII-4
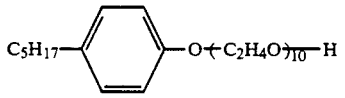
SII-5
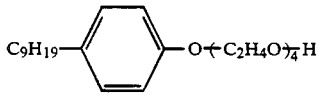
SII-6
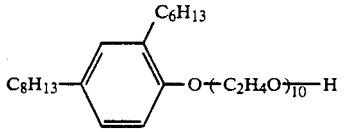
SII-7
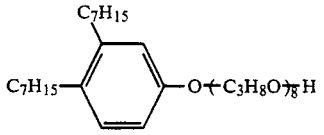
SII-8
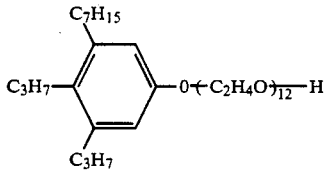
SII-9
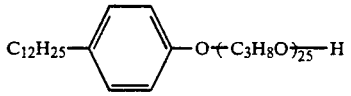
SII-10
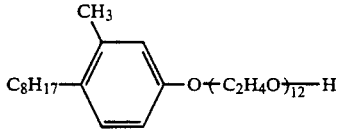
SII-11
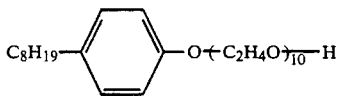
SII-12

-continued
SII-13
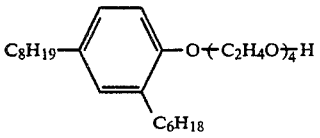
SII-14 $C_{12}H_{25}O(C_2H_4O)_4H$
SII-15 $C_6H_{13}-O(C_2H_4O)_{10}H$
SII-16 $C_8H_{17}-O(C_2H_4O)_{15}$
SII-17 $C_{10}H_{21}-O(C_2H_4O)_{10}-H$
SII-18 $C_{12}H_{25}-O(C_2H_4O)_{15}-H$
SII-19 $C_{14}H_{28}-O(C_2H_4O)_{15}-H$
SII-20
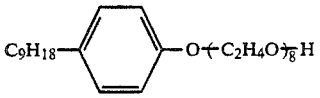
SII-21
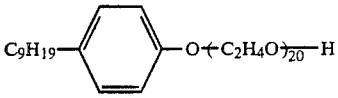
SII-22
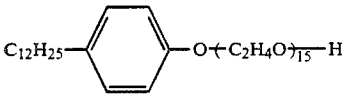
SII-23
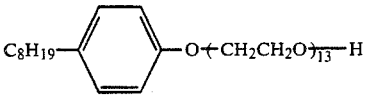
SII-24
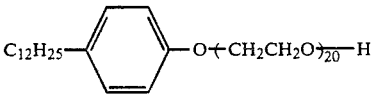
SII-25
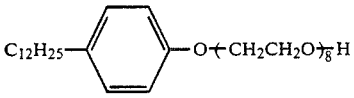
SII-26
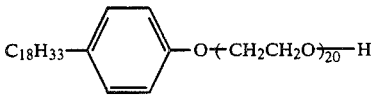
SII-27
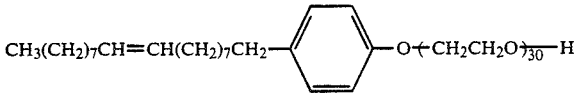
SII-28
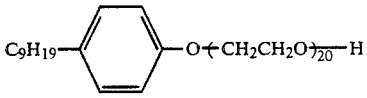
SII-29
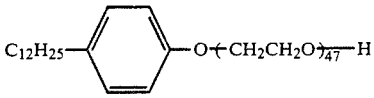

-continued
SII-30
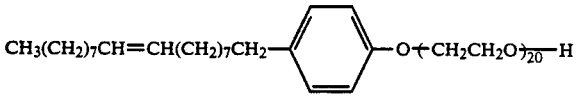
SII-31
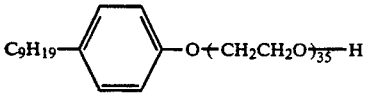
SII-32
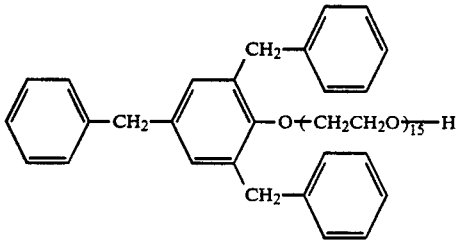
SII-33
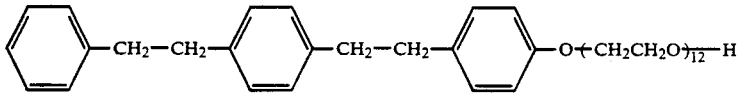
SII-34
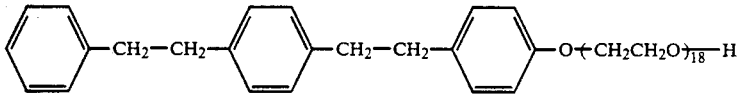
SII-35
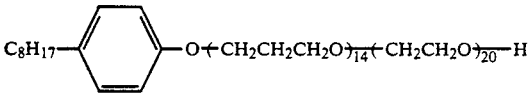
SII-36
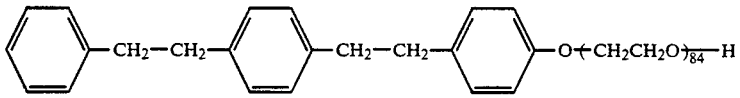
SII-37
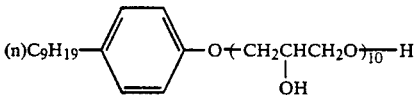
SII-38
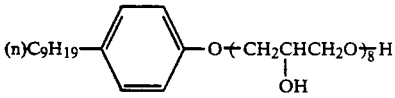
SII-39
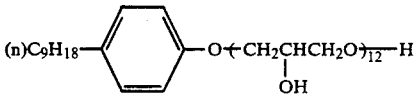
SII-40
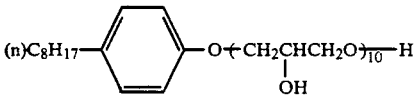
SII-41
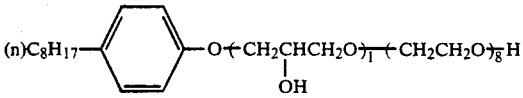

-continued
SII-42
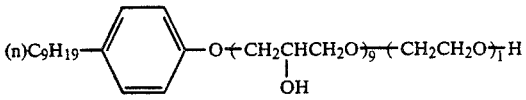
SII-43
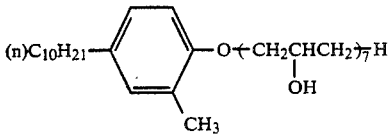
SII-44
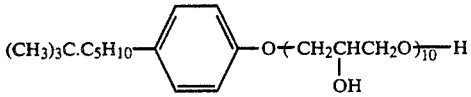
SII-45
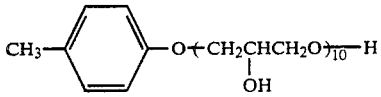
SII-46 $(n)C_{13}H_{27}-O(CH_2CH_2O)_5H$
SII-47 $C_{12}H_{25}-O(CH_2CH_2O)_{10}H$
SII-48 $C_{18}H_{37}-O(CH_2CH_2O)_{10}H$
SII-49 $(n)C_{10}H_{21}-O(CH_2CH_2O)_4H$
SII-50 $(n)C_{18}H_{33}-O(CH_2CH_2O)_4H$
SII-51 $(n)C_{12}H_{25}-O(CH_2CH(OH)CH_2O)_{10}H$
SII-52 $(n)C_{12}H_{25}-O(CH_2CH(OH)CH_2O)_2(CH_2CH_2O)_8H$
SII-53 $(n)C_{13}H_{27}-O(CH_2CH_2O)_4H$
SII-54
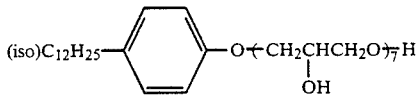
SII-55
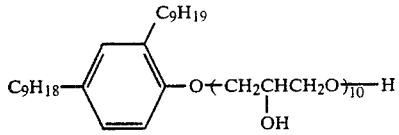
SII-56
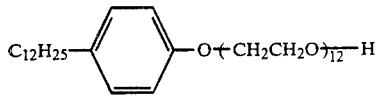
SII-57
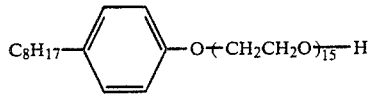
SII-58
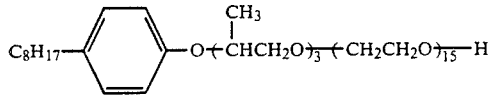

-continued
SII-59
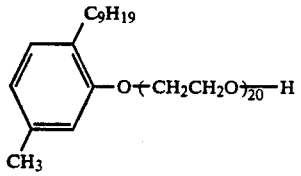
SII-60
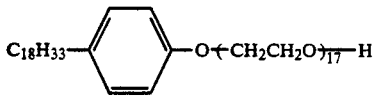
SII-61
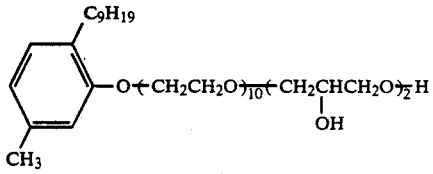
SII-62
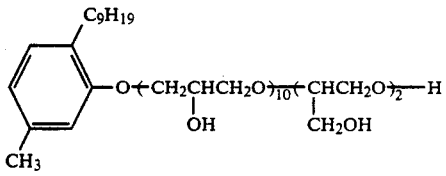
SII-63
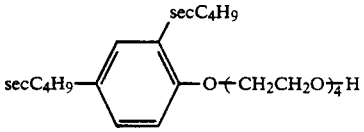
SII-64
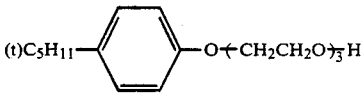
SII-65
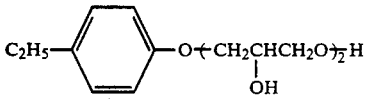
SII-66
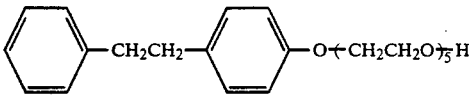
SII-67
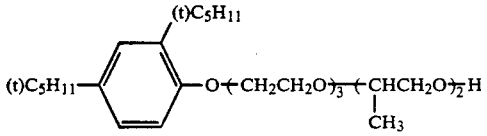
SII-68
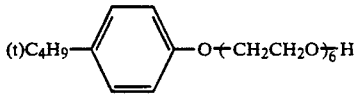
SII-69
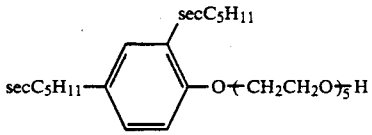

-continued

SII-70

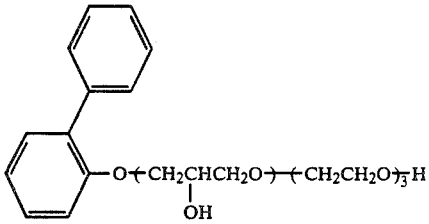

SII-71

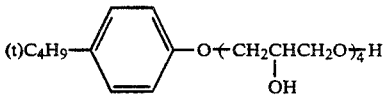

SII-72

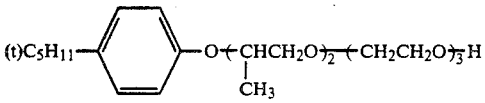

SII-73

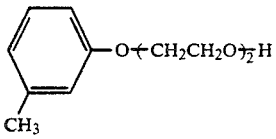

SII-74

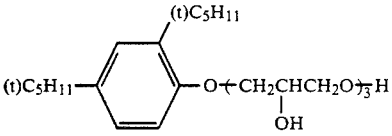

SII-75

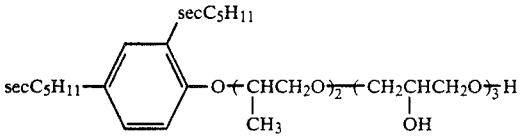

SII-76

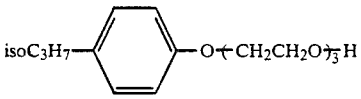

SII-77

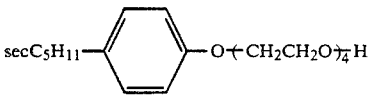

SII-78

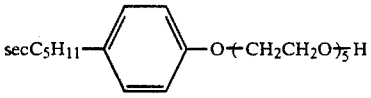

The water-soluble surface active agent may preferably be added in an amount of from 0.1 to 40 g, and more preferably from 0.3 to 20 g, per liter of the stabilizing solution.

The water-soluble organic siloxane compound may preferably be a compound represented by the following Formula SU-I.

Formula SU-I.

-continued

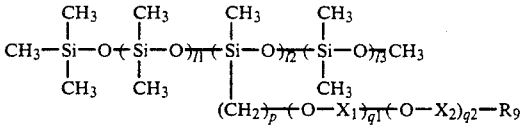

wherein $R_9$ represents a hydrogen atom, a hydroxyl group, a lower alkyl group, an alkoxyl group,

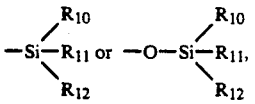

wherein $R_{10}$, $R_{11}$ and $R_{12}$ each represent a hydrogen atom or a lower alkyl group, and these $R_{10}$, $R_{11}$ and $R_{12}$ may be the same or different from each other. 11 to 13 each represent an integer of 0 or 1 to 30, and p, q1 and q2 each represent an integer of 0 or 1 to 30.

$X_1$ and $X_2$ each represent $-CH_2CH_2-$, $-CH_2CH_2CH_2-$,

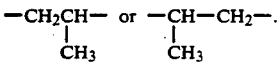

Examples of the compound represented by Formula SU-I are shown below.

Water-soluble organic siloxane compounds:

SU-I-1

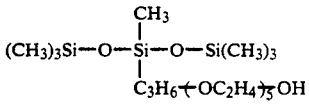

SU-I-2

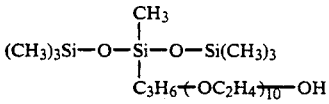

SU-I-3

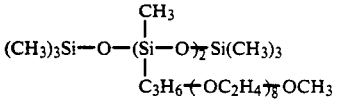

SU-I-4

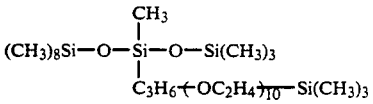

SU-I-5

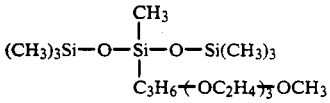

SU-I-6

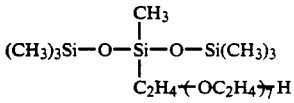

SU-I-7

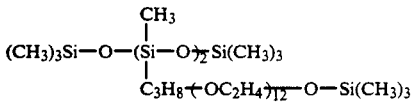

SU-I-8

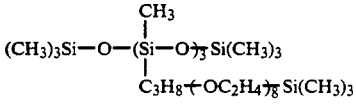

SU-I-9

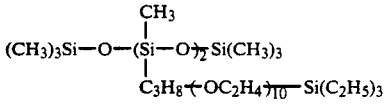

-continued

SU-I-10

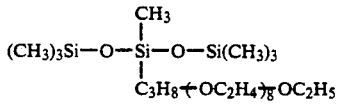

SU-I-11

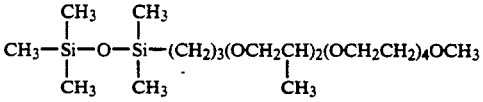

SU-I-12

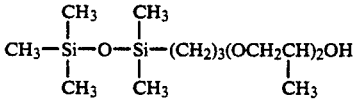

SU-I-13

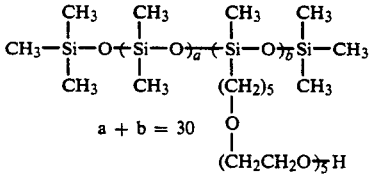

SU-I-14

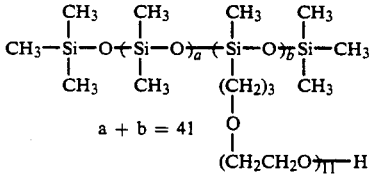

SU-I-15

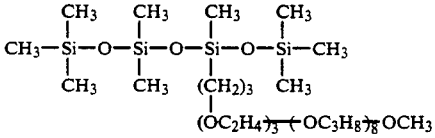

SU-I-16

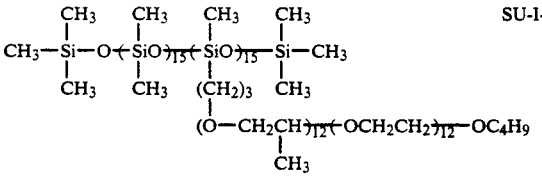

SU-I-17

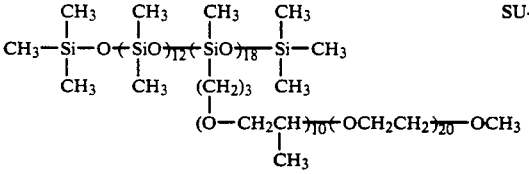

SU-I-18

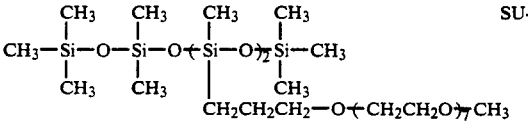

SU-I-19

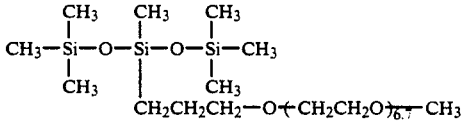

SU-I-20

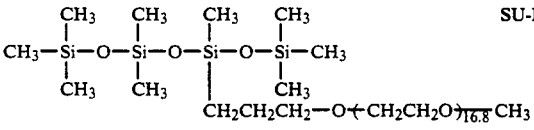

-continued

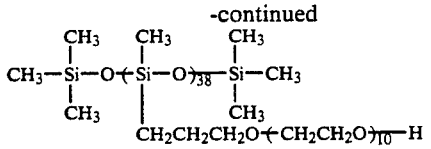

SU-I-21

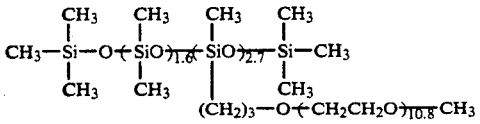

SU-I-22

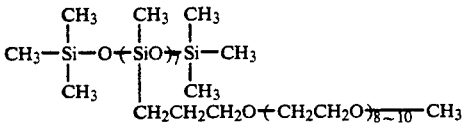

SU-I-23

Any of these water-soluble organic siloxane compounds having a polyoxyalkylene group may be added in an amount of from 0.01 to 20 g per liter of the stabilizing solution. Its addition within that range can be effective, in particular, effective for preventing precipitation from taking place and preventing yellow staining from occurring. Its addition in an amount less than 0.01 g/lit. may result in a conspicuous contamination of the surface of the light-sensitive material, and its addition in an amount more than 20 g/lit. may make the organic siloxane compound adhere to the surface of the light-sensitive material in a large quantity, resulting in an increase in the contamination.

The water-soluble organic siloxane compound of the present invention means the commonly available water-soluble organic siloxane compounds as disclosed in, for example, Japanese Patent O.P.I. Publication No. 18333/1972, Japanese Patent Examined Publications No. 51172/1980 and No. 37538/1976, Japanese Patent O.P.I. Publication No. 62128/1974, and U.S. Pat. No. 3,545,970.

These water-soluble organic siloxane compounds are readily available from UCC (Union Carbide Corp.) or shin-Etsu Chemical Co., Ltd.

In the present invention, what is meant by "the stabilizing solution may contain substantially no formaldehyde" is that the former may contain the latter in an amount including 0 (zero) and not more than 0.2 g per liter of the stabilizing solution.

In the present invention, the stabilizing solution may preferably be replenished in an amount of not more than 800 ml per 1 $m^2$ of the light-sensitive material. Since, however, replenishment in an excessively reduced quantity may cause discoloration of dyes or deposition of salts on the surface of the light-sensitive material, it may more preferably be replenished in an amount of not less than 100 ml and not more than 620 ml. Specific amount of replenishment may vary depending on how stabilizing bath tanks are constituted. The more the number of the tanks are, the lower its value can be made.

The stabilizing solution may preferably have a pH in the range of from 2 to 12, more preferably in the range of from 4 to 11 particularly from the viewpoint of promoting the effect of the present invention, and particularly preferably in the range of from 5 to 10. The stabilizing solution may preferably have a temperature in the range of from 15° C. to 70° C., and more preferably in the range of from 20° C. to 55° C. The processing with the stabilizing solution may preferably be carried out for 120 seconds or less, more preferably from 3 seconds to 90 seconds, and most preferably from 6 seconds to 60 seconds.

In the present invention, the stabilizing bath, when two or more tanks are used, may be of the counter-current system (a system in which the solution is fed to a postbath and overflowed therefrom into a forebath), which is particularly preferable in view of the effect of the present invention, in particular, the low environmental pollution and the improvement in image storage stability.

In the present invention, the stabilizing solution may preferably contain a chelating agent having a chelate stability constant with respect to iron ions, of not less than 8. Here, the chelate stability constant refers to the constant commonly known from L. G. Sillen and A. E. Martell, "Stability Constants of Metal-ion Complexes", The Chemical Society, London (1964), and S. Chaberek and A. E. Martell, "Organic Sequestering Agents", Wiley (1959).

The chelating agent having a chelate stability constant with respect to iron ions, of not less than 8 may include those disclosed in Japanese Patent Applications No. 234776/1990 and Japanese Patent O.P.I. Publication No. 182750/1991.

The above chelating agent may preferably be used in an amount of from 0.01 to 50 g, and more preferably from 0.05 to 20 g, per liter of the stabilizing solution, within the ranges of which good results can be obtained.

Preferred compounds that can be added to the stabilizing solution may include ammonium compounds. These are fed by ammonium salts of various inorganic compounds. The ammonium compound may be added in an amount preferably ranging from 0.001 mol to 1.0 mol, and more preferably ranging from 0.002 mol to 2.0 mols, per liter of the stabilizing solution.

The stabilizing solution may preferably also contain a metal salt used in combination with the above chelating agent. Such a metal salt may include salts of metals such as Ba, Ca, Ce, Co, In, La, Mn, Ni, Bi, Pb, Sn, Zn, Ti, Zr, Mg, Al and Sr. It can be fed in the form of an inorganic salt such as a halide, a hydroxide, a sulfate, a carbonate, a phosphate and an acetate, or in the form of water-soluble chelating agents. The metal salt may preferably be used in an amount ranging from $1\times10^{-4}$ to $1\times10^{-1}$ mol, and more preferably ranging from $4\times10^{-4}$ to $2\times10^{-2}$ mol, per liter of the stabilizing solution.

To the stabilizing solution, it is also possible to add a salt of an organic acid such as citric acid, acetic acid, succinic acid, oxalic acid or benzoic acid, a pH adjuster such as phosphate, borate, hydrochloric acid or sulfate, and so forth. These compounds may be used in any combination in any amount necessary for maintaining the pH of the stabilizing bath and in such an amount that its addition does not adversely affect the stability required when color photographic images are stored, and the prevention of occurrence of precipitates.

In the present invention, an antifungal agent may preferably be contained in the stabilizing solution. Such an antifungal agent may include compounds represented by the following Formulas B-1 to B-3. Use thereof in combination with the stabilizing solution can well bring about the intended effect of the present invention.

Formula B-1

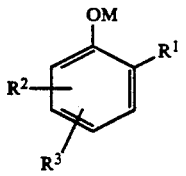

wherein $R^1$ represents an alkyl group, an cycloalkyl group, an aryl group, a hydroxyl group, an alkoxycarbonyl group, an amino group a carboxylic acid group (including a salt thereof) or a sulfonic acid group (including a salt thereof); $R^2$ and $R^3$ each represent a hydrogen atom, a halogen atom, an amino group, a nitro group, a hydroxyl group, an alkoxycarbonyl group, a carboxylic acid group (including a salt thereof) or a sulfonic acid group (including a salt thereof); and M represents a hydrogen atom, an alkali metal or an ammonium group.

Formula B-2

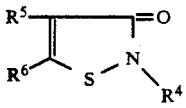

Formula B-3

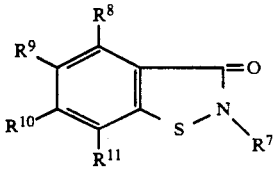

wherein $R^4$ represents a hydrogen atom, a halogen atom, an alkyl group, an aryl group, a halogenated alkyl group, $—R^{12}—OR^{13}$, $—CONHR^{14}$ (wherein $R^{12}$ represents an alkyl group and $R^{13}$ and $R^{14}$ each represent a hydrogen atom, an alkyl group or an arylalkyl group) or an arylalkyl group; $R^5$ and $R^6$ each represent a hydrogen atom, a halogen atom, a halogenated alkyl group or an alkyl group; $R^7$ represents a hydrogen atom, a halogen atom, an alkyl group, an aryl group, a halogenated alkyl group, an arylalkyl group, $—R^{15}—OR^{16}$ or $—CONHR^{17}$ (wherein $R^{15}$ represents an alkylene group, and $R^{16}$ and $R^{17}$ each represent a hydrogen atom or an alkyl group); $R^8$, $R^9$, $R^{10}$ and $R^{11}$ each represent a hydrogen atom, a halogen atom, a hydroxyl group, an alkyl group, an amino group or a nitro group.

The compounds represented by Formulas B-1 to B-3 will be further described below.

Examples of the compound represented by Formula B-1 are shown below.

(B-1-1)

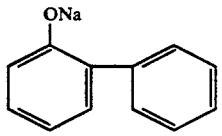

(B-1-2)

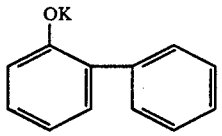

-continued (B-1-3)

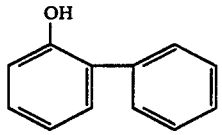

(B-1-4)

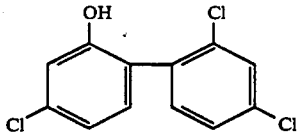

(B-1-5)

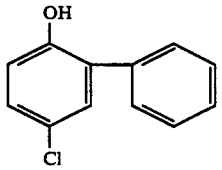

(B-1-6)

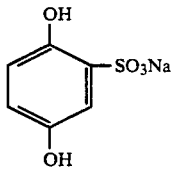

(B-1-7)

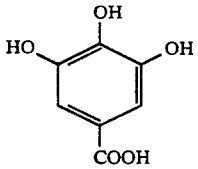

(B-1-8)

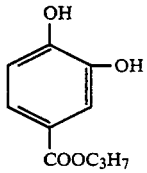

(B-1-9)

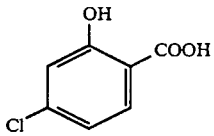

(B-1-10)

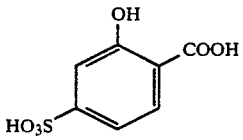

(B-1-11)

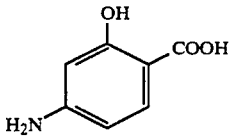

(B-1-12)

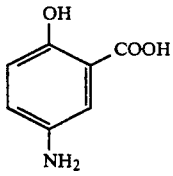

-continued (B-1-13)

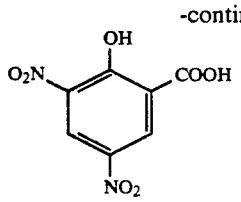

(B-1-14)

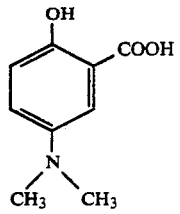

(B-1-15)

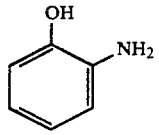

(B-1-16)

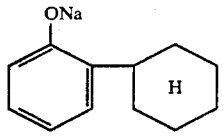

(B-1-17)

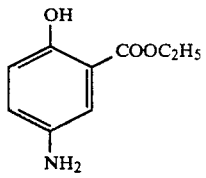

(B-1-18)

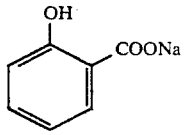

(B-1-19)

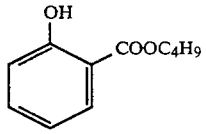

Some of compounds included in the above compound represented by Formula B-1, used in the present invention are known as antifungal agents for oranges or the like and commercially available. They are thus readily available to those skilled in the art. Of the above exemplary compounds, preferred compounds are B-1-1, B-1-2, B-1-3, B-1-4 and B-1-5.

The above compound represented by Formula B-1, used in the present invention may preferably be used in an amount of from 0.03 to 50 g, more preferably from 0.12 to 10 g, and particularly preferably from 0.15 to 5 g, per liter of the stabilizing solution of the present invention.

Specific examples of the compounds represented by Formulas B-2 and B-3 are shown below.

[B-2-1] 2-Methyl-4-isothiazolin-3-one
[B-2-2] 5-Chloro-2-methyl-4-isothiazolin-3-one
[B-2-3] 2-Methyl-5-phenyl-4-isothiazolin-3-one
[B-2-4] 4-Bromo-5-chloro-2-methyl-4-isothiazolin-3-one
[B-2-5] 2-Hydroxymethyl-4-isothiazolin-3-one
[B-2-6] 2-(2-Ethoxyethyl)-4-isothiazolin-3-one
[B-2-7] 2-(N-methyl-carbamoyl)-4-isothiazolin-3-one
[B-2-8] 5-Bromoethyl-2-(N-dichlorophenyl-carbamoyl)-4-isothiazolin-3-one
[B-2-9] 5-Chloro-2-(2-phenylethyl)-4-isothiazolin-3-one
[B-2-10] 4-Methyl-2-(3,4-dichlorophenyl)-4-isothiazolin-3-one
[B-3-1] 1,2-Benzisothiazolin-3-one
[B-3-2] 2-(2-Bromoethyl)-1,2-benzisothiazolin-3-one
[B-3-3] 2-Methyl-1,2-benzisothiazolin-3-one
[B-3-4] 2-Ethyl-5-nitro-1,2-benzisothiazolin-3-one
[B-3-5] 2-Benzyl-1,2-benzisothiazolin-3-one
[B-3-6] 5-Chloro-1,2-benzisothiazolin-3-one Synthesis methods of these exemplary compounds and examples of their application to other industrial fields are disclosed in U.S. Pat. Nos. 2,767,172, 2,767,173, 2,767,174 and 2,870,015, British Patent No. 848,130, French Patent No. 1,555,416, etc. Some compounds are on the market and available under trade names of TOPCIDE 300 (Permachem Asia Ltd.), TOPCIDE 600 (Permachem Asia Ltd.), FINECIDE J-700 (Tokyo Fine Chemical Co., Ltd.), or PROXEL GXL (I.C.I. Organics, Inc.).

Any of these compounds B-2 and B-3 may preferably be used in an amount ranging from 0.001 to 20 g, and more preferably ranging from 0.005 to 5 g, per liter of the stabilizing solution.

In the processing according to the present invention, silver may be recovered from the stabilizing solution. For example, the electrolytic process as disclosed in French Patent No. 2,299,667, the precipitation process as disclosed in Japanese Patent O.P.I. Publication No. 73037/1977 and German Patent No. 23 31 220, the ion-exchange process as disclosed in Japanese Patent O.P.I. Publication No. 17114/1976 and German Patent No. 25 48 237, and the metal displacement process as disclosed in British Patent No. 1,353,805 can be effectively used. Such silver recovery is particularly preferable when silver is recovered from a tank solution by in-line treatment using the electrolytic process or an anion-exchange resin, since the rapid processing adaptability can be thereby more improved. Alternatively, silver may also be recovered from overflow waste liquor and regenerated for its use.

The stabilizing solution may also be subjected to a treatment such as ion exchange, electrodialysis (see Japanese Patent O.P.I. Publication No. 28949/1986), reverse osmosis (see Japanese Patent O.P.I. Publications No. 240153/1985 and No. 254151/1987) or the like. As the water used in the stabilizing solution, it is also preferred to use water having been dionized. This is because its use can achieve improvements in the antifungal properties of the stabilizing solution, the stability of the stabilizing solution and the storage stability of images. The water may be deionized by any methods so long as the washing water can be made to contain Ca and Mg ions in a concentration of 5 ppm or less after processing. For example, it is preferred to use, alone or in combination, treatments using an ion-exchange resin and a reverse osmosis membrane. The ion-exchange resin and the reverse osmosis membrane are disclosed in detail in KOKAI GIHO (Voluntary Technical Publication) 87-1984 or 89-20511.

After stabilizing, it is not necessary at all to carry out washing. It, however, is possible to optionally carry out rinsing, surface cleaning, etc. in a very short time using water in a very small quantity.

A color developing agent used in the step of color developing may include aminophenol compounds and p-phenylenediamine compounds. In the present invention, it is preferred to use a p-phenylenediamine compound having a water-soluble group. As to such a water-soluble group, at least one group may be present on the amino group or benzene nucleus of the p-phenylenediamine compound processing solution.

As specific water-soluble groups, the group may preferably include the following:

$-(CH_2)_n-CH_2OH$, $-(CH_2)_m-NHSO_2-(CH_2)_n-CH_3$, $-(CH_2)_m-O-(CH_2)_n-CH_3$, $-(CH_2CH_2O)_nC_mH_{2m+1}$ wherein m and n each represent an integer of 0 or more), a —COOH group and an $-SO_3H$ group.

Examples of the color developing agent, preferably used in the present invention, include those disclosed in Japanese Patent O.P.I. Publication No. 182750/1991 and Japanese Patent Application No. 234776/1990, etc.

The color developing agent may preferably be added in an amount of not less than $0.5\times10^{-2}$ mol, more preferably in the range of from $1.0\times10^{-2}$ to $1.0\times10^{-1}$ mol, and most preferably in the range of from $1.5\times10^{-2}$ to $7.0\times10^{-2}$ mol, per liter of a color developing solution.

The color developing agent used in the color developing step may contain compounds usually used in developing solutions.

The color developing solution may usually have a pH of 7 or more, and preferably from about 9 to about 13.

In continuous processing, the color developing solution may preferably be replenished in an amount of not more than 1.5 liter, more preferably from 250 ml to 900 ml, and still more preferably from 300 ml to 700 ml, per 1.0 $m^2$ of the light-sensitive material in the case of light-sensitive color photographic materials for photographing.

In the present invention, a bleaching agent used in the bleaching solution or bleach-fixing solution may include a ferric complex salt of an organic acid represented by the following Formula A or B.

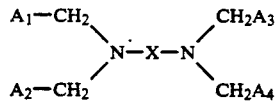

Formula A wherein $A_1$ to $A_4$ may be the same or different and each represent $-CH_2OH$, —COOM or $PO_3M_1M_2$, wherein M, $M_1$ and $M_2$ each represent a hydrogen atom, an alkali metal atom or an ammonium group; and X represents a substituted or unsubstituted alkylene group having 3 to 6 carbon atoms, as exemplified by propylene, butylene or pentamethylene. The substituent may include a hydroxyl group and an alkyl group having 1 to 3 carbon atoms.

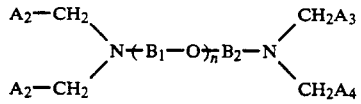

Formula B wherein $A_1$ to $A_4$ are the same as those defined in Formula A; n represent an integer of 1 to 8; $B_1$ and $B_2$ may be the same or different and each represent a substituted or unsubstituted alkylene group having 2 to 5 carbon atoms, as exemplified by ethylene, propylene, butylene or pentamethylene. The substituent may include a hydroxyl group, and an alkyl group having 1 to 3 carbon atoms as exemplified by a methyl, ethyl or propyl group.

The compounds represented by Formulas A and B will be detailed below.

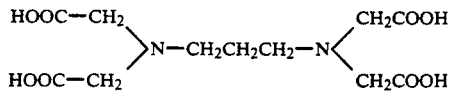

(A-1)

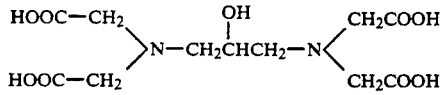

(A-2)

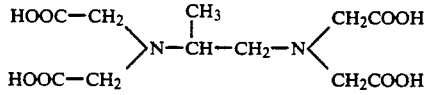

(A-3)

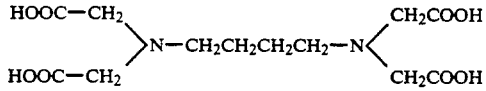

(A-4)

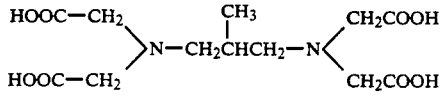

(A-5)

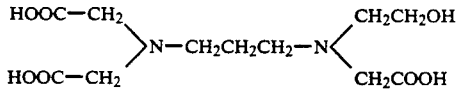

(A-6)

-continued

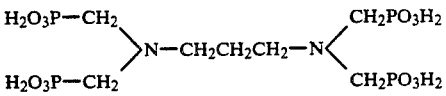
(A-7)

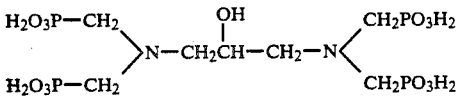
(A-8)

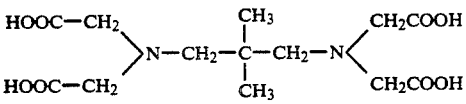
(A-9)

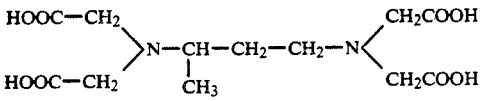
(A-10)

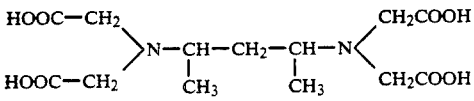
(A-11)

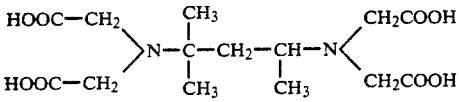
(A-12)

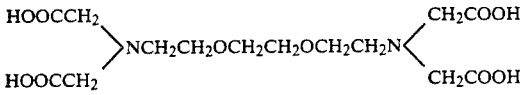
(B-1)

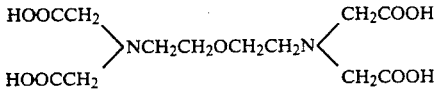
(B-2)

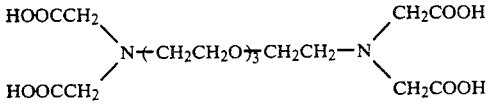
(B-3)

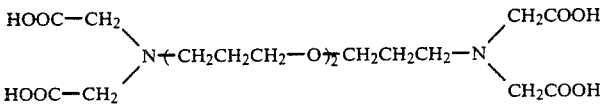
(B-4)

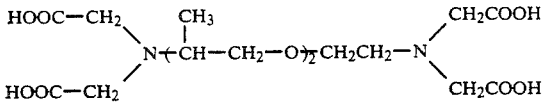
(B-5)

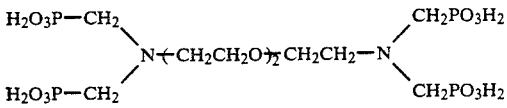
B-6

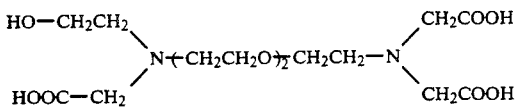
(B-7)

The ferric complex salts of these compounds A-1 to A-12 and B-1 to B-7 can be arbitrarily used in the form of sodium salts, potassium salts or ammonium salts of these ferric complex salts.

Of the above examples of the compounds, the compounds A-1, A-3, A-4, A-5, A-9, A-10, A-11, B-1, B-2 and B-7 are particularly preferably used. The compounds A-1 and B-1 are more particularly preferably used.

The organic acid ferric complex salt may preferably be added in an amount ranging from 0.1 mol to 2.0 mol, and more preferably from 0.15 mol to 1.5 mol, per liter of the bleaching solution.

In the bleaching solution or bleach-fixing solution, a preferred bleaching agent other than the ferric salts of the compound represented by Formula A or B can be exemplified by the compounds as disclosed in Japanese Patent Application No. 302784/1990, page 79, line 1 to page 80, line 20.

When the organic acid ferric complex salt is used in combination of two or more kinds, the ferric complex salt of the compound of Formula A or B may preferably comprise not less than 70% (as a molar basis), more preferably not less than 80%, particularly preferably not less than 90%, and most preferably not less than 95%, from the viewpoint of bringing about a better effect of the present invention.

In the bleaching solution, bleach-fixing solution and fixing solution, at least one of the imidazoles or derivatives thereof as disclosed in Japanese Patent O.P.I. Publication No. 295258/1989 or the compounds represented by Formula I to IX and exemplary compounds thereof as disclosed in the specification of the same publication may be contained as an accelerator. This can be effective for rapid processing.

Besides the above accelerators, it is also possible to use the exemplary compounds disclosed in Japanese Patent O.P.I. Publication No. 123459/1987, pages 51 to 115 of its specification, the exemplary compounds disclosed in Japanese Patent O.P.I. Publication No. 17445/1985, pages 22 to 25 of its specification, and the compounds disclosed in Japanese Patent O.P.I. Publications No. 95630/1978 and No. 28426/1978.

These accelerators may be used alone or in combination of two or more kinds, and may preferably be added in an amount ranging from approximately 0.001 g to 100 g, more preferably 0.05 g to 50 g, and particularly preferably 0.05 g to 15 g. The bleaching solution or bleach-fixing solution should be used at a temperature of 20° C. to 50° C., and preferably 25° C. to 45° C. The pH of the bleaching solution may preferably be not more than 6.0, and more preferably be controlled to be not less than 1.0 and not more than 5.5. The pH of the bleaching solution may preferably be from 5.0 to 9.0, and more preferably from 6.0 to 8.5. The pH of the bleaching solution or bleach-fixing solution is the pH of the processing bath solution used in the processing of light-sensitive silver halide photographic materials, and can be clearly distinguished from the pH of what is called a replenisher or replenishing solution.

The bleaching solution or bleach-fixing solution may also be incorporated with other known compounds.

The bleaching solution or bleach-fixing solution may preferably be replenished in an amount of not more than 500 ml, more preferably 20 ml to 400 ml, and most preferably 40 ml to 350 ml, per 1 $m^2$ of the light-sensitive silver halide color photographic material. The effect of the present invention becomes more remarkable as the solution is replenished in a smaller amount.

In the present invention, air or oxygen may optionally be blown in processing baths and processing solution replenisher holding tanks so that the activity of the bleaching solution or bleach-fixing solution can be increased. Alternatively, a suitable oxidant as exemplified by hydrogen peroxide, a bromate or a persulfate may be appropriately added.

As for a fixing agent used in the fixing solution or bleach-fixing solution, known fixing agents can be used. A preferable fixing agent may include a thiosulfate and a thiocyanate.

The thiocyanate may preferably be contained in an amount of not less than 0.1 mol/lit. In the case when color negative films are processed, it may more preferably be in an amount of not less than 0.3 mol/lit., and particularly preferably not less than 0.5 mol/lit. The thiosulfate may be contained in an amount of not less than 0.2 mol/lit. In the case when color negative films are processed, it may more preferably be in an amount of not less than 0.5 mol/lit. In addition to such a fixing agent, the bleach-fixing solution or fixing solution may also contain one or more kinds of known pH buffers.

The fixing solution or bleach-fixing solution should further contain a large quantity of a re-halogenating agent such as an alkali halide or ammonium halide, as exemplified by potassium bromide, sodium bromide, sodium chloride or ammonium bromide. It is also possible to appropriately add compounds which are known to be usually added to fixing solutions or bleach-fixing solutions, as exemplified by alkylamines and polyethylene oxides.

Silver may be recovered from the bleach-fixing solution or fixing solution by known methods.

The fixing solution may usually be replenished in an amount of from 50 ml to 900 ml, and preferably in the range of from 100 ml to 500 ml, per 1 $m^2$ of the light-sensitive material.

The fixing solution may preferably have a pH in the range of from 4 to 8.

The compound represented by the following Formula FA, disclosed in Japanese Patent O.P.I. Publication No. 295258/1989, page 56 of its specification, together with its exemplary compounds, may preferably be added to the processing solution having a fixing ability, whereby not only the effect of the present invention can be well obtained but also an additional effect can be obtained such that sludge may much less occur in the processing solution having a fixing ability, when light-sensitive materials are processed in a small quantity over a long period of time.

Formula FA:

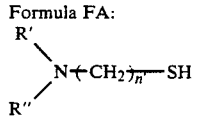

The compounds represented by Formula FA as described in that specification can be synthesized by usual methods as disclosed in U.S. Pat. Nos. 3,335,161 and 3,260,718. The compounds represented by Formula FA may each be used alone or in combination of two or more kinds.

These compounds represented by Formula FA may be added in an amount of 0.1 g to 200 g per liter of the processing solution, within the range of which good results can be obtained.

The processing using the bleaching solution according to the present invention and that using the fixing solution may each be carried out for any desired time. The processing may each preferably be carried out for not more than 3 minutes 30 seconds, more preferably in the range of from 10 seconds to 2 minutes 20 seconds, and particularly preferably from 20 seconds to 1 minute 20 seconds. The processing using the bleach-fixing solution may preferably be carried out for not more than 4 minutes, and more preferably in the range of from 10 seconds to 2 minutes 20 seconds.

In the processing method of the present invention, it is preferred as an embodiment of the present invention to bring the bleaching solution, the bleach-fixing solution or the fixing solution under forced liquid stirring. This is because not only the effect as aimed in the present invention can be better attained but also the adaptability to rapid processing should be taken into account. Herein what is meant by the forced liquid stirring is not the usual diffusion movement in a solution but the stirring forcedly carried out with a stirring means additionally applied. As a means for the forced stirring, it is possible to employ the means as disclosed in Japanese Patent O.P.I. Publication No. 222259/1989 and No. 206343/1989.

In the present invention, the solution cross-over time between baths, e.g., from a color developing bath to a bleach-fixing bath or bleach-fixing bath should be not longer than 10 seconds, and preferably not longer than 7 seconds. This is effective for the prevention of bleach fog, which is an effect different from that of the present invention.

The processing solutions used in the present invention have been described above. In addition to what has been set forth, the processing solutions may also contain the additives as described below.

With regard to the bleaching solution, usual additives as disclosed in Japanese Patent O.P.I. Publication No. 44347/1990, pages 3–4, and Japanese Patent O.P.I. Publication No. 43546/1990, pages 37–38, may be used, which disclose a bleaching agent, the pH, an acid, the amount of the acid added, a bleaching accelerator, etc. With regard to the fixing solution, usual additives as disclosed in Japanese Patent O.P.I. Publication No. 44347/1990, page 4, may also be used, which disclose a fixing agent, a fixing accelerator, a preservative, a chelating agent, etc. As the bleach-fixing solution, the one disclosed in Japanese Patent O.P.I. Publication No. 43546/1990, pages 37–38, may also be used. In the stabilizing solution according to the present invention, it is also possible to use the fungicide, antifungal agent, chelating agent, fluorescent brightening agent, etc. as disclosed in Japanese Patent O.P.I. Publication No. 43546/1990, pages 38–39.

In the light-sensitive silver halide color photographic material used in the present invention, the silver halide emulsions as disclosed in Research Disclosure No. 308119 (hereinafter "RD308119") can be used.

In the present invention, silver halide emulsions having been subjected physical ripening, chemical ripening and spectral sensitization are used. Additives used in such steps are described in Research Disclosures No. 17643, No. 18716 and No. 308119 (hereinafter "RD17643", "RD18716" and "RD308119", respectively).

Known photographic additives that can be used in the present invention are also described in the above Research Disclosures.

Various couplers can be used in the light-sensitive material used in the present invention. Examples thereof are described in the above Research Disclosures.

The additives used in the present invention can be added by the dispersion method as described in RD308119, Paragraph XIV.

In the present invention, the supports as described in the aforesaid RD17643, page 28, RD18716, pages 647–648 and RD308119, Paragraph XIX can be used.

The light-sensitive material can be provided with the auxiliary layers such as filter layers and intermediate layers as described in RD308119, Paragraph VII-K. The light-sensitive material used in the present invention can be comprised of various layers of conventional layer order, inverse layer order or unit structure as described in the aforesaid RD308119, VII-K.

In the present invention, the invention can be made well effective when the light-sensitive material contains at least one of the compounds represented by Formulas B-1 to B-3.

The present invention can be applied to light-sensitive color photographic materials for general use or for use in motion pictures or the like, such as color papers, color negative films, color reversal films, color reversal papers, direct positive color papers, movie color films and television color films. It can be greatly effective particularly when applied to transmission light-sensitive color photographic materials.

EXAMPLES

Specific examples of the present invention will be described below. Embodiments of the present invention are by no means limited to these.

Example 1

The following stabilizing solutions were prepared.

1,2-Benzisothiazolin-3-one 0.05 g

| | |
|---|---|
| 1,2-Benzisothiazolin-3-one | 0.05 g |
| Surface active agent (exemplary compound SII-5) so adjusted as to give a surface tension of 30 dyne/cm | |
| Exemplary compound | as shown in Table 1 |
| Fixing solution*1) | 100 ml |
| Made up to 1 liter by adding water, and the pH was adjusted to 8.0. | |

*1)The fixing solution was composed of the following:

| | |
|---|---|
| Ammonium thiosulfate | 180 g |
| Ammoinum sulfite | 15 g |
| Silver bromide | 0.5 g |

Made up to 1 liter by adding water, and adjusted to pH 7.0 using ammonium hydroxide or glacial acetic acid.

After the solutions were prepared, they were each stored at 30° C. in a beaker with an open-top area of 10 $cm^2$/lit., and evaluation was made on how many days lapsed before precipitates are produced because of sulfiding. Results obtained are shown in Table 1.

TABLE 1

| Stabilizing solution No. | Additive (per liter) | | Storage stability (Days before occurrence of sulfiding) |
|---|---|---|---|
| 1-1 | — | | 12 days |
| 1-2 | Formaldehyde (35%) | 0.6 ml | 1 day |
| 1-3 | " | 4.0 ml | <1 day |
| 1-4 | Hexamethylenetetramine | 2.5 g | 3 days |
| 1-5 | Diemthylolurea | 2.5 g | 2 days |
| 1-6 | Acetaldehyde | 2.5 g | 2 days |
| 1-7 | Exemplary compound 2 | 2.5 g | 9 days |
| 1-8 | Exemplary compound 3 | 2.5 g | 10 days |
| 1-9 | Exemplary compound 8 | 2.5 g | 7 days |
| 1-10 | Exemplary compound 15 | 2.5 g | 6 days |
| 1-11 | Exemplary compound 21 | 2.5 g | 7 days |
| 1-12 | Exemplary compound 23 | 2.5 g | 8 days |
| 1-13 | Exemplary compound 28 | 2.5 g | 7 days |
| 1-14 | Exemplary compound 31 | 2.5 g | 7 days |
| 1-15 | Exemplary compound 40 | 2.5 g | 7 days |
| 1-16 | Exemplary compound 52 | 2.5 g | 7 days |
| 1-17 | Exemplary compound 54 | 2.5 g | 7 days |
| 1-18 | Exemplary compound 66 | 2.5 g | 7 days |

TABLE 1-continued

| Stabilizing solution No. | Additive (per liter) | | Storage stability (Days before occurrence of sulfiding) |
|---|---|---|---|
| 1-19 | Exemplary compound 75 | 2.5 g | 7 days |

As is clear from Table 1, stabilizing solutions 1-2 to 1-3 to which formaldehyde is added shows an extremely poor storage stability of the solution. No good storage stability is also seen in stabilizing solutions 1-4 to 1-6 making use of conventional formaldehyde substitute compounds.

On the other hand, stabilizing solutions 1-7 to 1-19 making use of the compounds of the present invention all show a good solution storage stability.

Example 2

In this Example, the amounts of the components added in the light-sensitive silver halide photographic material are indicated as gram number per 1 $m^2$ unless particularly noted. Those of silver halides and colloidal silver are indicated in terms of silver.

On a triacetyl cellulose film support, the following layers were formed successively from the support side to produce a multi-layer light-sensitive color photographic material, sample 1.

| Sample 1 | |
|---|---|
| First layer: Anti-halation layer | |
| Black colloidal silver | 0.18 |
| Ultraviolet absorbent UV-1 | 0.20 |
| Colored coupler CC-1 | 0.05 |
| Colored coupler CM-2 | 0.06 |
| High-boiling solvent Oil-1 | 0.20 |
| Gelatin | 1.5 |
| Second layer: Intermediate layer | |
| Ultraviolet absorbent UV-1 | 0.01 |
| High-boiling solvent Oil-1 | 0.01 |
| Gelatin | 1.2 |
| Third layer: Low-speed red-sensitive emulsion layer | |
| Silver iodobromide emulsion Em-1 | 0.9 |
| Silver iodobromide emulsion Em-2 | 0.6 |
| Spectral sensitizer S-1 | $2.2 \times 10^{-4}$ mol/mol · Ag |
| Spectral sensitizer S-2 | $2.5 \times 10^{-4}$ mol/mol · Ag |
| Spectral sensitizer S-3 | $0.5 \times 10^{-4}$ mol/mol · Ag |
| Cyan coupler C-4' | 1.2 |
| Cyan Coupler C-2' | 0.3 |
| Colored cyan coupler CC-1 | 0.05 |
| DIR compound D-1 | 0.002 |
| High-boiling solvent Oil-1 | 0.5 |
| Gelatin | 1.2 |
| Fourth layer: High-speed red-sensitive emulsion layer | |
| Silver iodobromide emulsion Em-3 | 2.0 |
| Spectral sensitizer S-1 | $2.2 \times 10^{-4}$ mol/mol · Ag |
| Spectral sensitizer S-2 | $2.0 \times 10^{-4}$ mol/mol · Ag |
| Spectral sensitizer S-3 | $0.1 \times 10^{-4}$ mol/mol · Ag |
| Cyan coupler C-1' | 0.20 |
| Cyan coupler C-2' | 0.03 |
| Cyan coupler C-3' | 1.15 |
| Colored cyan coupler CC-1 | 0.015 |
| DIR compound D-2 | 0.05 |
| High-boiling solvent Oil-1 | 0.5 |
| Gelatin | 1.3 |
| Fifth layer: Intermediate layer | |
| Gelatin | 0.5 |
| Sixth layer: Low-speed green-sensitive emulsion layer | |
| Silver iodobromide emulsion Em-1 | 1.1 |
| Spectral sensitizer S-4 | $5 \times 10^{-4}$ mol/mol · Ag |
| Spectral sensitizer S-5 | $2 \times 10^{-4}$ mol/mol · Ag |
| Magenta coupler M-1 | 0.45 |
| Colored magenta coupler CM-1 | 0.05 |
| DIR compound D-3 | 0.015 |

-continued

| Sample 1 | |
|---|---|
| DIR compound D-4 | 0.020 |
| High-boiling solvent Oil-2 | 0.5 |
| Gelatin | 1.0 |
| Seventh layer: Intermediate layer | |
| Gelatin | 0.9 |
| High-boiling solvent Oil-3 | 0.2 |
| Eighth layer: High-speed green-sensitive emulsion layer | |
| Silver iodobromide emulsion Em-3 | 1.2 |
| Spectral sensitizer S-6 | $1.5 \times 10^{-4}$ mol/mol · Ag |
| Spectral sensitizer S-7 | $2.5 \times 10^{-4}$ mol/mol · Ag |
| Spectral sensitizer S-8 | $0.7 \times 10^{-4}$ mol/mol · Ag |
| Magenta coupler M-2 | 0.08 |
| Magenta coupler M-3 | 0.18 |
| Colored magenta coupler CM-2 | 0.05 |
| DIR compound D-3 | 0.01 |
| High-boiling solvent Oil-3 | 0.5 |
| Gelatin | 0.5 |
| Ninth layer: Yellow filter layer | |
| Yellow colloidal silver | 0.12 |
| Anti-color-stain agent SC-1 | 0.1 |
| High-boiling solvent Oil-3 | 0.1 |
| Gelatin | 0.8 |
| Tenth layer: Low-speed blue-sensitive emulsion layer | |
| Silver iodobromide emulsion Em-1 | 0.30 |
| Silver iodobromide emulsion Em-2 | 0.25 |
| Spectral sensitizer S-10 | $7 \times 10^{-4}$ mol/mol · Ag |
| Yellow coupler Y-1 | 0.6 |
| Yellow coupler Y-2 | 0.2 |
| DIR compound D-2 | 0.01 |
| High-boiling solvent Oil-3 | 0.15 |
| Gelatin | 1.2 |
| Eleventh layer: High-speed blue-sensitive emulsion layer | |
| Silver iodobromide emulsion Em-4 | 0.50 |
| Silver iodobromide emulsion Em-1 | 0.22 |
| Spectral sensitizer S-9 | $1.3 \times 10^{-4}$ mol/mol · Ag |
| Spectral sensitizer S-10 | $3 \times 10^{-4}$ mol/mol · Ag |
| Yellow coupler Y-1 | 0.36 |
| Yellow coupler Y-2 | 0.12 |
| High-boiling solvent Oil-3 | 0.07 |
| Gelatin | 1.2 |
| Twelvth layer: First protective layer | |
| Fine-grain silver iodobromide emulsion (average grains size: 0.08 μm; AgI: 2.5 mol %) | 0.40 |
| Ultraviolet absorbent UV-1 | 0.10 |
| Ultraviolet absorbent UV-2 | 0.05 |
| High-boiling solvent Oil-1 | 0.1 |
| High-boiling solvent Oil-4 | 0.1 |
| Formalin scavenger HS-1 | 0.5 |
| Formalin scavenger HS-2 | 0.2 |
| Gelatin | 1.2 |
| Thirteenth layer: Second protective layer | |
| Surface active agent Su-1 | 0.005 |
| Alkali-soluble matting agent (average particle diameter: 2 μm) | 0.10 |
| Cyan dye AIC-1 | 0.01 |
| Magenta dye AIM-1 | 0.01 |
| Lubricant WAX-1 | 0.04 |
| Gelatin | 0.7 |

In addition to the above composition, coating aid Su-2, dispersing agent Su-3, anticeptic agent DI-1, stabilizer Stab-1 and antifoggants AF-1 and AF-2 were added to each layer.

Em-1:

A monodisperse emulsion with a surface low silver iodide content, having an average grains size of 0.46 μm and an average silver iodide content of 7.0 mol %.

Em-2:

A monodisperse emulsion with a uniform composition, having an average grains size of 0.32 μm and an average silver iodide content of 2.5 mol %.

Em-3:

A monodisperse emulsion with a surface low silver iodide content, having an average grains size of 0.78 μm and an average silver iodide content of 6.0 mol %.

Em-4:

A monodisperse emulsion with a surface low silver iodide content, having an average grains size of 0.95 μm and an average silver iodide content of 7.5 mol %.

The emulsions Em-1, Em-3 and Em-4 are silver iodobromide emulsions prepared by making reference to Japanese Patent O.P.I. Publications No. 138538/1985 and No. 245151/1986, having a multi-layer structure and mainly comprised of octahedral grains. Em-1 to Em-4 each have an average grain size/grain thickness value of 1.0, and a breadth of grain size distribution of 14%, 10% m 12% and 12%, respectively.

S-1

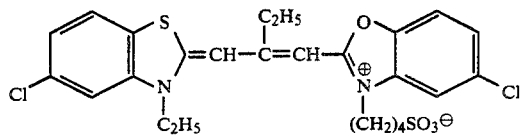

S-2

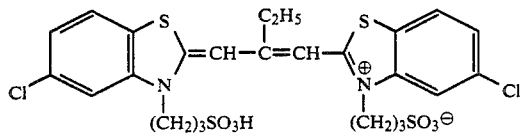

S-3

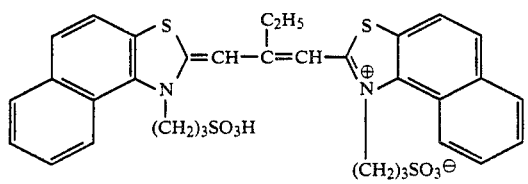

S-4

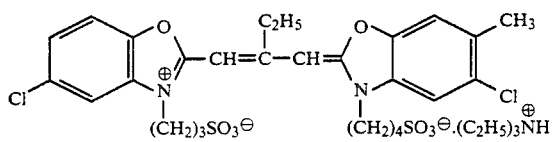

S-5

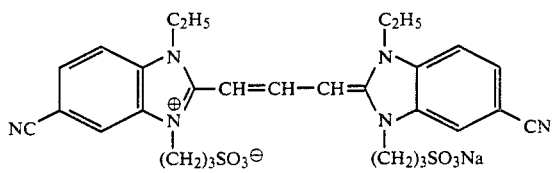

S-6

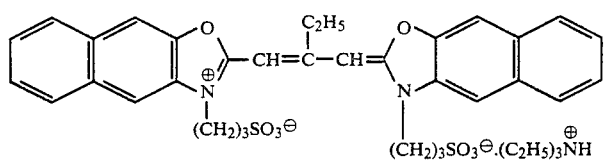

S-7

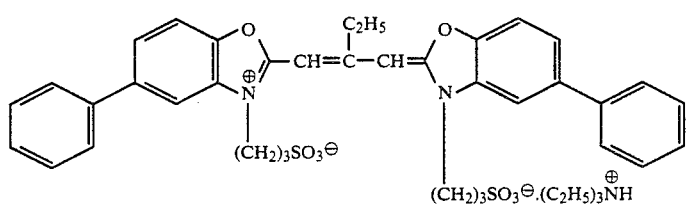

S-8

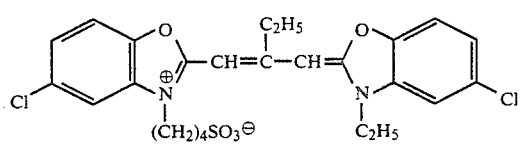

-continued
S-9
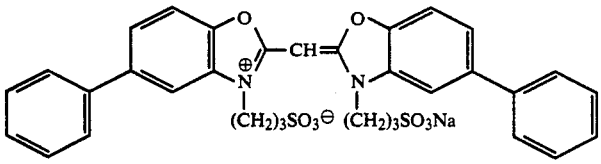
S-10
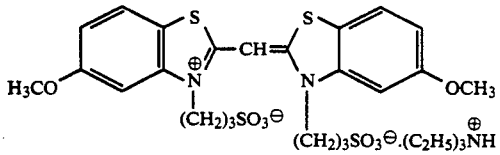
C-1'
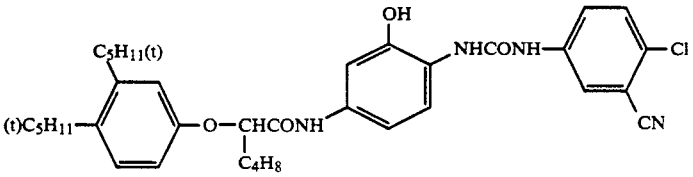
C-2'
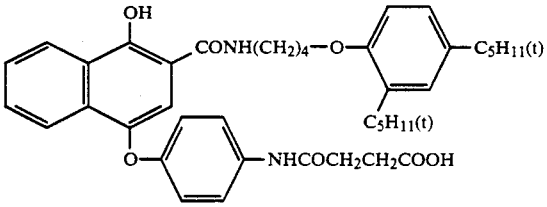
C-3'
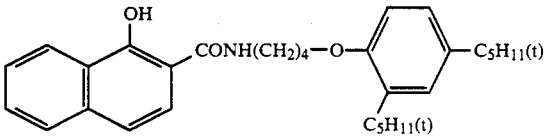
C-4'
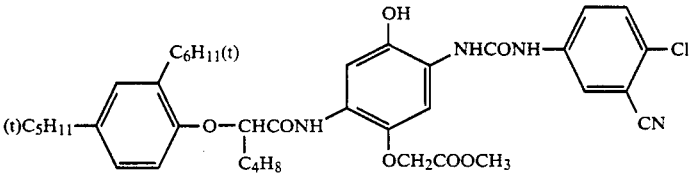
M-1
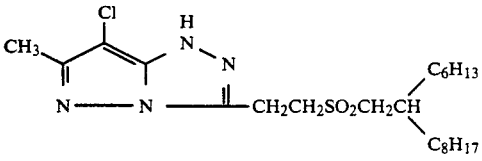
M-2
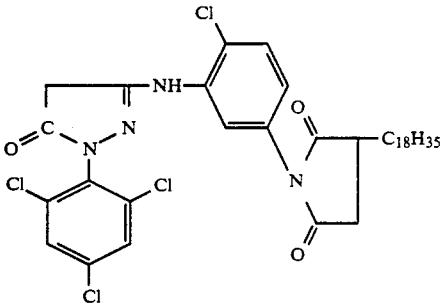

-continued
M-3
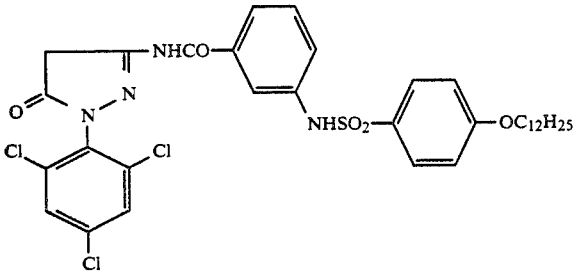
Y-1
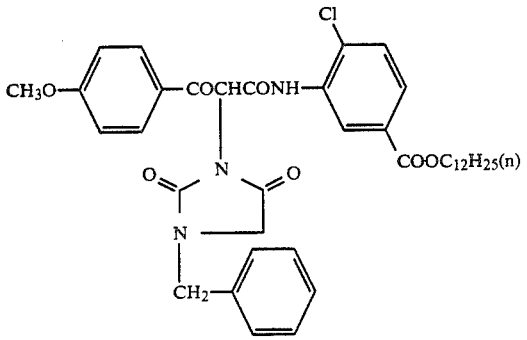
Y-2
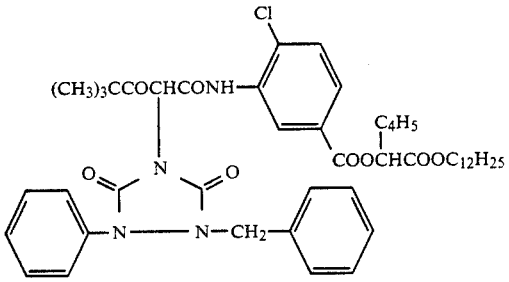
CC-1
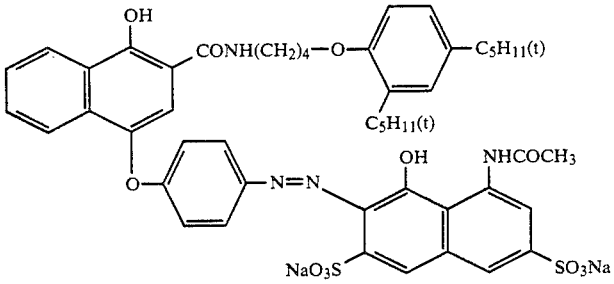
CM-1
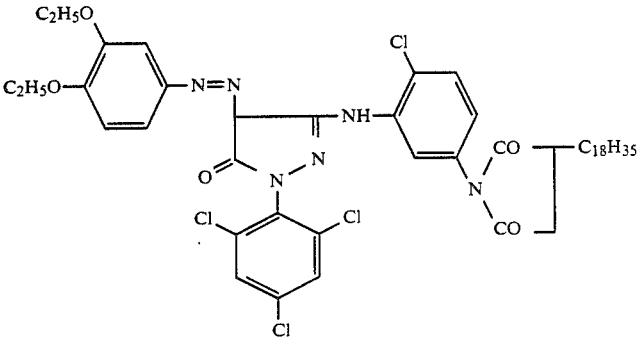

-continued
CM-2
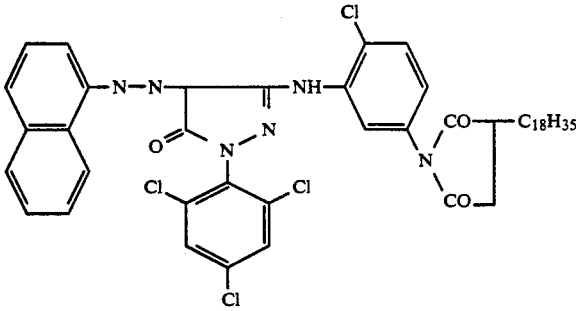
D-1
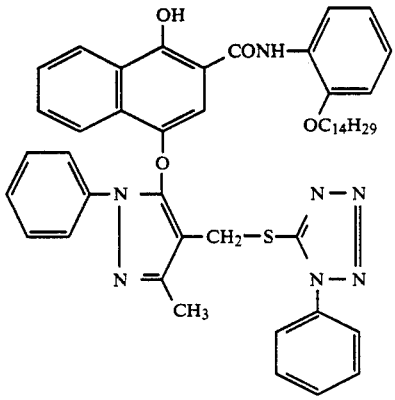
D-2
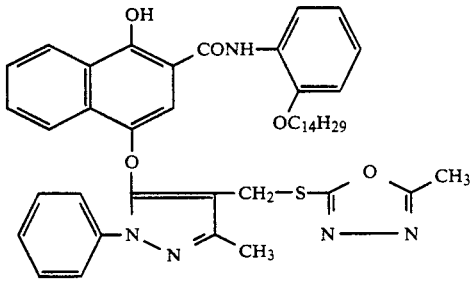
D-3
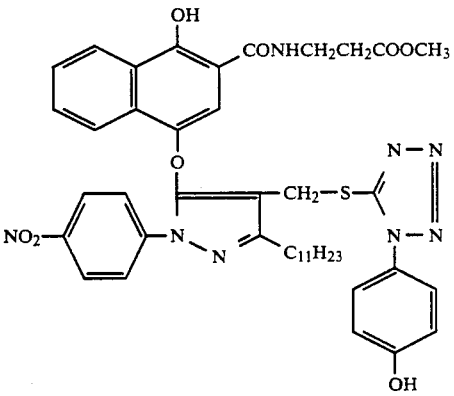

-continued
D-4
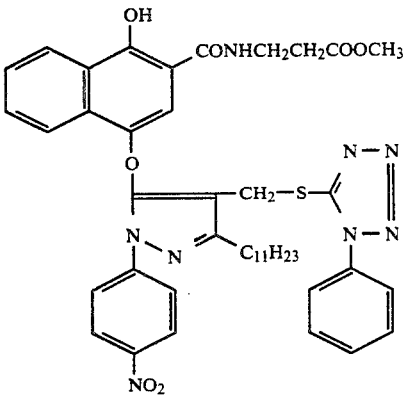
UV-1
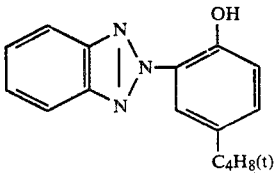
UV-2
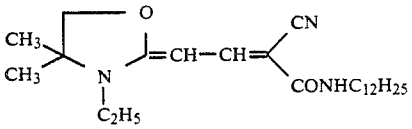
HS-1
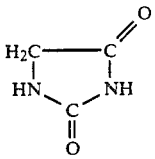
HS-2
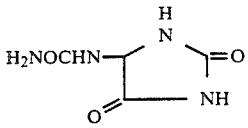
H-1
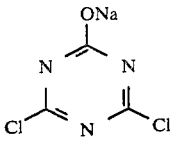
H-2
$((CH_2{=}CHSO_2CH_2)_3CCH_2SO_2(CH_2)_2)_2N$
$(CH_2)_2SO_3K$
Su-1
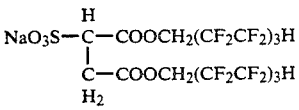
Su-2
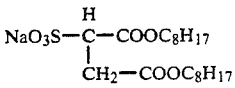
Su-3
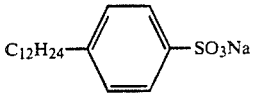

-continued
WAX-1
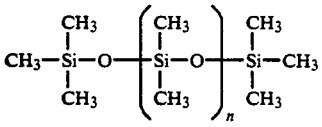
Sc-1
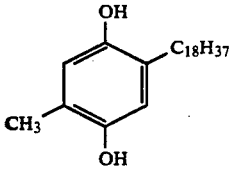
AIC-1
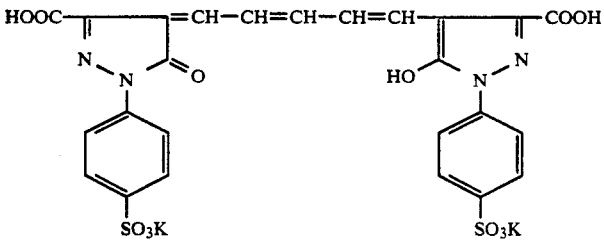
AIM-1
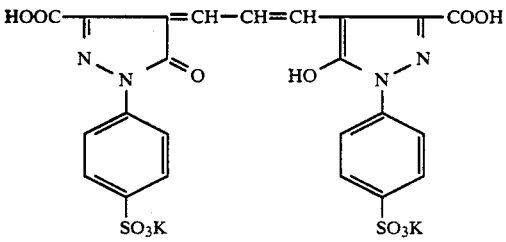
Stab-1
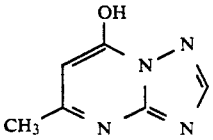
AF-1
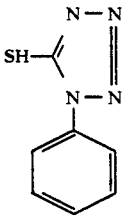
AF-2
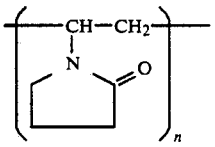
DI-1
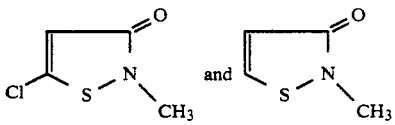
Oil-1
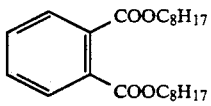

-continued

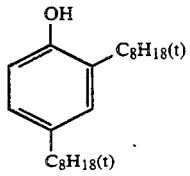

Oil-2

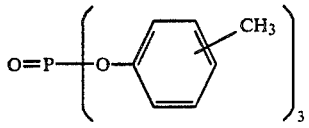

Oil-3

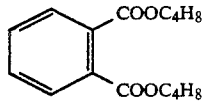

Oil-4

The film sample thus prepared was subjected to practical exposure using a camera, and running tests were carried out under the following conditions.

| Processing Step | Processing Time | Processing temperature | Amount of replenishing |
|---|---|---|---|
| Color developing | 3 min 15 sec | 38° C. | 775 ml |
| Bleaching | 45 sec | 38° C. | 155 ml |
| Fixing | 1 min 30 sec | 38° C. | 500 ml |
| Stabilizing | 50 sec | 38° C. | 775 ml |
| Drying | 1 min | 40–70° C. | — |

The amount of replenishing is indicated as a value per 1 $m^2$ of light-sensitive material.

The stabilizing was carried out in a two-bath countercurrent and by a system in which the stabilizing solution is replenished to the final bath and its overflow is flowed into the forebath.

| | |
|---|---|
| Color developing solution | |
| Potassium carbonate | 30 g |
| Sodium hydrogencarbonate | 2.5 g |
| Potassium sulfite | 3.0 g |
| Sodium bromide | 1.2 g |
| Potassium iodide | 0.6 mg |
| Hydroxylamine sulfate | 2.5 g |
| Sodium chloride | 0.6 g |
| 4-Amino-3-methyl-N-ethyl-N-(β-hydroxyethyl)aniline sulfate | 4.6 g |
| Diethylenetriaminepentaacetic acid | 3.0 g |
| Potassium hydroxide | 1.2 g |
| Made up to 1 liter by adding water, and adjusted to pH 10.01 using potassium hydroxide or 20% sulfuric acid. | |
| Color developing replenishing solution | |
| Potassium carbonate | 40 g |
| Sodium hydrogencarbonate | 3 g |
| Potassium sulfite | 7 g |
| Sodium bromide | 0.5 g |
| Hydroxylamine sulfate | 3.1 g |
| 4-Amino-3-methyl-N-ethyl-N-(β-hydroxyethyl)aniline sulfate | 6.0 g |
| Diethylenetriaminepentaacetic acid | 3.0 g |
| Potassium hydroxide | 2 g |
| Made up to 1 liter by adding water, and adjusted to pH 10.12 using potassium hydroxide or 20% sulfuric acid | |
| Bleaching solution | |
| Ferric ammonium 1,3-propylenediaminetetraacetate | 0.32 mol |
| Disodium ethylenediaminetetraacetate | 10 g |
| Ammonium bromide | 100 g |
| Glacial acetic acid | 40 g |
| Ammonium nitrate | 40 g |

-continued

| | |
|---|---|
| Made up to 1 liter by adding water, and adjusted to pH 4.4 using ammonia water. | |
| Bleaching replenishing solution | |
| Ferric ammonium 1,3-propylenediaminetetraacetate | 0.35 mol |
| Disodium ethylenediaminetetraacetate | 2 g |
| Ammonium bromide | 120 g |
| Ammonium nitrate | 50 g |
| Glacial acetic acid | 40 g |
| Made up to 1 liter by adding water, and adjusted to pH 3.4 using ammonia water. | |
| Fixing solution and fixing replenishing solution | |
| Ammonium thiosulfate | 200 g |
| Anhydrous sodium bisulfite | 20 g |
| Sodium metabisulfite | 4.0 g |
| Disodium ethylenediaminetetraacetate | 1.0 g |
| Urea | 1.0 g |
| Made up to 1 liter by adding water, and adjusted to pH 6.5 using glacial acetic acid and ammonia water. | |

Stabilizing solution and stabilizing replenishing solution

The same stabilizing solution as in Example 1 was used.

Running processing was carried out using an automatic processor, until the relenishing solution was supplied in a threefold quantity of the capacity of the stabilizing tank.

Magenta densities at minimum density portions were measured on processed film samples on which the running processing was completed. Then the samples were stored for two weeks in an environment of a humidity of 20% RH, and the magenta maximum densities after storage were measured to determine the rate of discoloration (or fading) of dyes.

The samples were also stored for two weeks in an environment of a humidity of 60% RH, and their yellow densities at non-image portions were measured to determine yellow stain. The state of back-side deposits of the film samples on which the running processing was completed was also observed.

The second-tank solution in the stabilizing tanks was stored at 25° C. in a beaker with an open-top area of 50 $cm^2$/lit., and evaluation was made on the solution storage stability (days before occurrence of sulfiding).

Results obtained are shown together in Table 2.

TABLE 2

| Test No. | Additive (per liter) | (1) | (2) | (3) | (4) |
|---|---|---|---|---|---|

TABLE 2-continued

| | | | | | | |
|---|---|---|---|---|---|---|
| 2-1 | — | | 52 | 0.12 | A | 15 days |
| 2-2 | Formaldehyde (35%) | 0.6 mol | 31 | 0.07 | A | 2 days |
| 2-3 | " | 4.0 ml | 7.0 | 0.00 | A | 1 day |
| 2-4 | Hexamethylene-tetramine | 2.5 g | 30 | 0.10 | B | 4 days |
| 2-5 | Dimethylolurea | 2.5 g | 34 | 0.13 | C | 3 days |
| 2-6 | Acetaldehyde | 2.5 g | 46 | 0.13 | C | 3 days |
| 2-7 | Exemplary comp. 1 | 2.5 g | 15.0 | 0.07 | A | 10 days |
| 2-8 | Exemplary comp. 2 | 2.5 g | 8.0 | 0.01 | A | 10 days |
| 2-9 | Exemplary comp. 3 | 2.5 g | 6.6 | 0.00 | A | 11 days |
| 2-10 | Exemplary comp. 4 | 2.5 g | 7.2 | 0.01 | A | 8 days |
| 2-11 | Exemplary comp. 6 | 2.5 g | 8.3 | 0.02 | A | 8 days |
| 2-12 | Exemplary comp. 11 | 2.5 g | 8.5 | 0.03 | A | 8 days |
| 2-13 | Exemplary comp. 16 | 2.5 g | 13.0 | 0.03 | A | 8 days |
| 2-14 | Exemplary comp. 37 | 2.5 g | 12.5 | 0.02 | A | 8 days |
| 2-15 | Exemplary comp. 41 | 2.5 g | 10.3 | 0.02 | A | 9 days |

(1): Rate of magenta dye fading ratio (%), storage at 75° C., 20% RH
(2): Yellow stain, storage at 75° C., 60% RH
(3): Back-side deposits
(4): Solution storage stability

| Test No. | Additive (per liter) | | (1) | (2) | (3) | (4) |
|---|---|---|---|---|---|---|
| 2-16 | Exemplary comp. 42 | 2.5 g | 11.2 | 0.03 | A | 9 days |
| 2-17 | Exemplary comp. 48 | 2.5 g | 14.2 | 0.02 | A | 8 days |
| 2-18 | Exemplary comp. 49 | 2.5 g | 8.6 | 0.01 | A | 10 days |
| 2-19 | Exemplary comp. 50 | 2.5 g | 8.2 | 0.01 | A | 10 days |
| 2-20 | Exemplary comp. 52 | 2.5 g | 11.8 | 0.02 | A | 9 days |
| 2-21 | Exemplary comp. 54 | 2.5 g | 12.3 | 0.03 | A | 8 days |
| 2-22 | Exemplary comp. 57 | 2.5 g | 9.2 | 0.01 | A | 10 days |

(1): Rate of discoloration, storage at 75° C., 20% RH
(2): Yellow stain, storage at 75° C., 60% RH
(3): Back-side deposits
(4): Solution storage stability In the table, in the evaluation of back-side deposits, letter symbols A, B and C means the following:

A: No back-side deposits occurred.

B: Back-side deposits slightly occurred.

C: Back-side deposits seriously occurred.

As is clear from the results shown in Table 2, use of formaldehyde in a large amount brings about no problem on the rate of discoloration and the back-side deposits, but results in a exemplary poor solution storage stability. In the cases of Test Nos. 2-4 to 2-6 in which the conventional formaldehyde susbstitute compounds are used, images fade at a high rate in an environment of low humidity, and also both the back-side deposits and the solution storage stability are poor.

On the other hand, in the cases in which the compounds of the present invention are used, good results are seen on the rate of discoloration particularly in an environment of low humidity, and also on both the back-side deposits and the solution storage stability.

Example 3

In Test No. 2-3 in Example 2, evaluation was made in the same way except for changing the composition of the stabilizing solution as follows:

| Stabilizing solution: | |
|---|---|
| 1,2-Benzothiazolin-3-one | 0.15 g |
| Exemplary compound 3 of Formula I compound | 3.0 g |
| Surface active agent | as shon in Table 3 |
| so adjusted as to give a surface tension as shown in Table 3 | |
| Made up to 1 liter by adding water, and adjusted to pH 7.5 using sodium hydroxide or sulfuric acid. | |

Rate of discoloration and yellow stain were evaluated in the same manner as in Example. Results obtained are shown in Table 3.

TABLE 3

| Test No. | Additive | Surface tension (dyne/cm) | Rate of discoloration (%) | Yellow stain |
|---|---|---|---|---|
| 3-1 | None | 70 | 8.0 | 0.16 |
| 3-2 | SI-14 | 60 | 7.6 | 0.06 |
| 3-3 | " | 45 | 7.0 | 0.02 |
| 3-4 | " | 35 | 6.8 | 0.01 |
| 3-5 | " | 30 | 6.6 | 0.01 |
| 3-6 | SII-5 | 60 | 7.6 | 0.05 |
| 3-7 | " | 45 | 7.0 | 0.02 |
| 3-8 | " | 35 | 6.8 | 0.01 |
| 3-9 | " | 30 | 6.6 | 0.00 |
| 3-10 | SU-I-6 | 60 | 7.5 | 0.04 |
| 3-11 | " | 45 | 7.1 | 0.02 |
| 3-12 | " | 35 | 6.6 | 0.01 |
| 3-13 | " | 30 | 6.5 | 0.01 |
| 3-14 | " | 20 | 6.4 | 0.00 |
| 3-15 | SU-I-12 | 60 | 7.5 | 0.04 |
| 3-16 | " | 45 | 7.0 | 0.02 |
| 3-17 | " | 35 | 6.7 | 0.01 |
| 3-18 | " | 30 | 6.4 | 0.01 |
| 3-19 | " | 20 | 6.3 | 0.00 |

As is clear from Table 3, use of the surface active agent as in Test Nos. 3-2 to 3-19 in the present invention brings about good results on the rate of discoloration and the yellow stain.

Example 4

Running processing was carried out and evaluation was made in the same manner as in Example 2 except that the magenta couplers M-2 and M-3 in the film sample used in Example 2 were replaced with the magenta coupler as shown in Table 4 below.

Results obtained are shown together in Table 4.

The magenta couplers used, shown in Table 4, are those disclosed in Japanese Patent Application No. 32501/1988, pages 208–227.

TABLE 4

| Test No. | Magenta coupler | Yellow stain |
|---|---|---|
| 4-1 | M-2 (shown below) | 0.01 |
| 4-2 | M-10 (shown below) | 0.01 |
| 4-3 | M-18 (shown below) | 0.00 |
| 4-4 | M-20 (shown below) | 0.02 |
| 4-5 | M-21 (shown below) | 0.01 |
| 4-6 | M-31 (shown below) | 0.02 |
| 4-7 | M-37 (shown below) | 0.01 |
| 4-8 | M-44 (shown below) | 0.02 |
| 4-9 | M-61 (shown below) | 0.00 |
| 4-10 | M-63 (shown below) | 0.02 |
| 4-11 | M-68 (shown below) | 0.02 |
| 4-12 | MR-1 (shown below) | 0.12 |
| 4-13 | MR-2 (shown below) | 0.18 |

TABLE 4-continued
| Test No. | Magenta coupler | Yellow stain |
|---|---|---|
| M-2 | 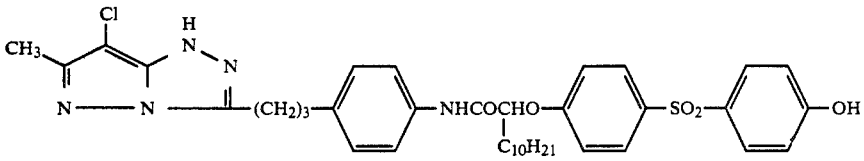 | |
| M-10 | 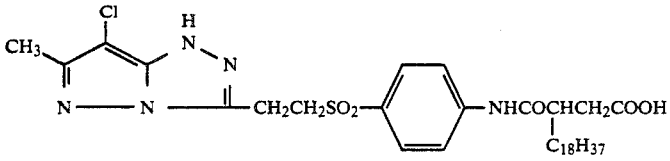 | |
| M-18 | 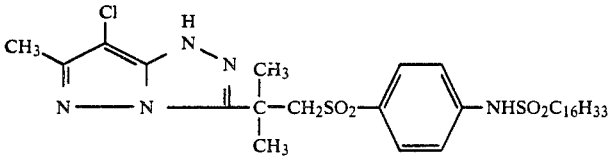 | |
| M-20 | 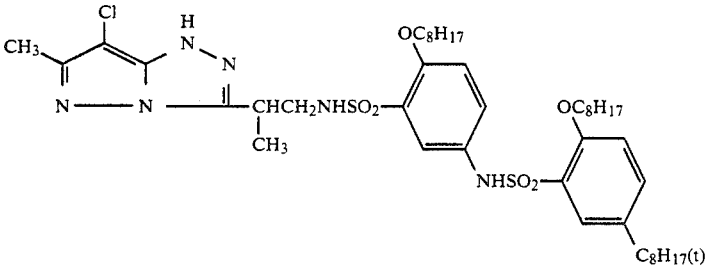 | |
| M-21 | 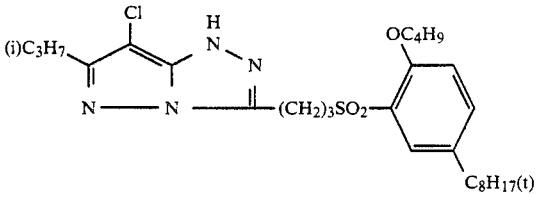 | |
| M-31 | 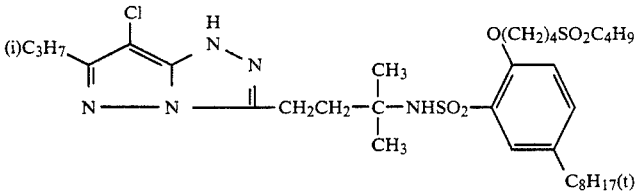 | |
| M-37 | 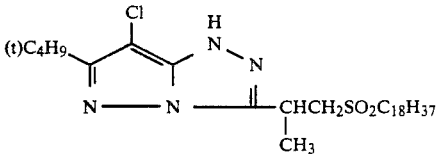 | |
| M-44 | 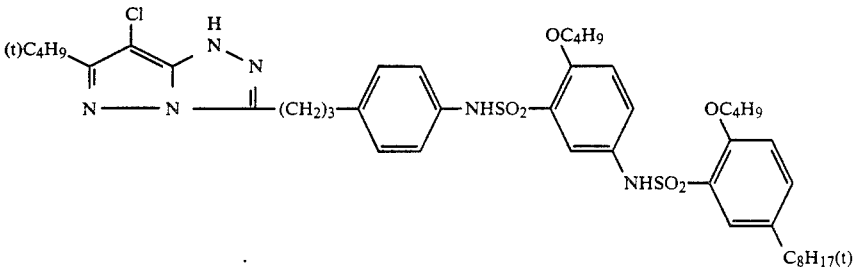 | |

TABLE 4-continued

| Test No. | Magenta coupler | Yellow stain |
|---|---|---|

M-61

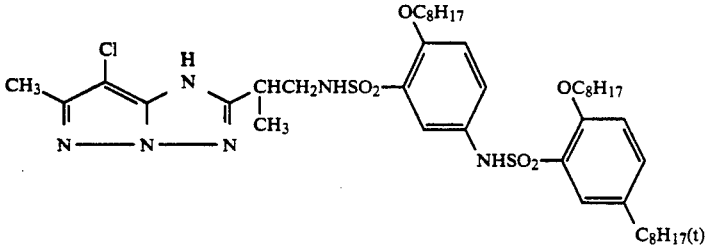

M-63

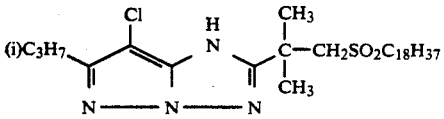

M-68

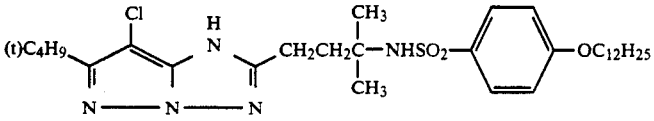

MR-1

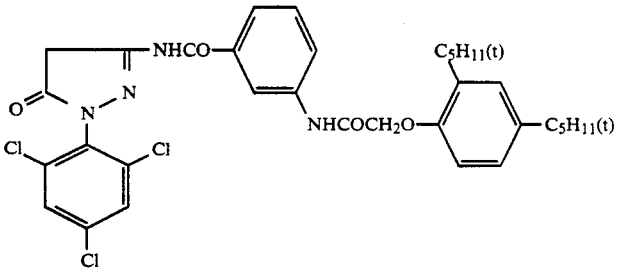

MR-2

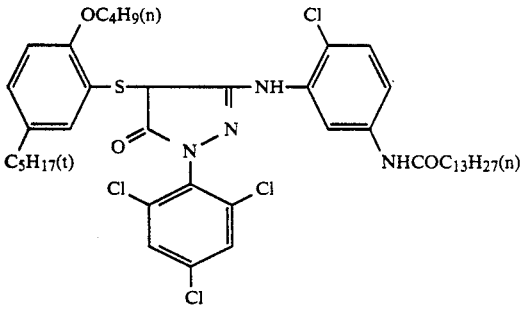

As is seen from the above Table 4, use of the pyrazoloazole type magenta coupler represented by Formula M-1, disclosed in Japanese Patent Application No. 32501/1988 brings about a better achievement of the effect of the present invention.

Example 5

Test No. 2-13 in Example 2 was repeated except that in the stabilizing solution used therein the following known ion-releasing compounds I-1 and I-2 were each added in an amount of 0.05 mol/lit. As a result, the rate of magenta discoloration and the back-side deposits were on substantially the same level, but the storage stability of the stabilizing solutions (days before occurrence of sulfiding) was improved by about 50%.

Glutaldehyde bisulfite addition product I-1

-continued

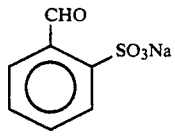

I-2

Example 6

A running test was carried out according to the following processing steps, replacing the bleaching solution and fixing solution used in example 2 with the following bleach-fixing solution.

| Processing Step | Processing Time | Processing temperature | Amount of replenishing |
|---|---|---|---|
| Color developing | 3 min 15 sec | 38° C. | 775 ml |
| Bleach-fixing | 3 min | 38° C. | 650 ml |

-continued

| Processing Step | Processing Time | Processing temperature | Amount of replenishing |
|---|---|---|---|
| Stabilizing | 1 min | 38° C. | 800 ml |
| Drying | 1 min | 40–70° C. | — |

| Bleach-fixing solution and bleach-fixing replenishing solution | |
|---|---|
| Ammonium thiosulfate | 240 g |
| Ferric ammonium diethylenetriaminepentaacetate | 150 g |
| Ammonium thiocyanate | 30 g |
| Ammonium sulfite | 15 g |
| Thiourea | 2 g |
| 2-Amino-5-mercapto-1,3,4-thiadiazole | 2 g |
| Made up to 1 liter by adding water, and adjusted to pH 7.0 using acetic acid and ammonia water. | |

Regarding other conditions, including the film sample, the test was carried out in the same manner as in Example 2. Results thus obtained were substantially the same as in Example 2.

Example 7

A running processing was carried out in the same manner as in Example 2 except that the bleaching solution and fixing solution were replaced with the following bleaching solution and bleach-fixing solution, the stabilizing was carried out in a three-bath countercurrent by a system in which the stabilizing solution was replenished to the final bath and its overflow is flowed into the forebath and by a system in which the whole overflow of the bleaching solution was flowed into the subsequent postbath bleach-fixing solution, and the processing was carried out according to the following processing steps. Results obtained were substantially the same as in Example 2.

| -Bleaching solution and bleaching replenishing solution - | |
|---|---|
| Ferric ammonium ethylenediaminetetraacetate | 100 g |
| Ferric ammonium 1,3-propylenediaminetetraacetate | 50 g |
| Ammonium bromide | 100 g |
| Ammonium nitrate | 45 g |
| Bleaching accelerator | 0.005 mol |

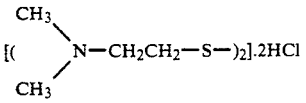

| | |
|---|---|
| Ammonia water (27%) | 12 ml |
| Acetic acid | 5 g |
| Made up to 1 liter by adding water, and adjusted to pH 6.0 using ammonia water and acetic acid. | |
| - Bleach-fixing solution and bleach-fixing replenishing solution - | |
| Ferric ammonium ethylenediaminetetraacetate | 50 g |
| Ethylenediaminetetraacetic acid | 3 g |
| Ammonium sulfite | 12 g |
| Ammonium thiosulfate | 170 g |
| Ammonium thiocyanate | 70 g |
| Ammonia water (27%) | 4.5 ml |
| Made up to 1 liter by adding water, and adjusted to pH 7.2 using ammonia water and acetic acid. | |

| Processing Step | Processing Time | Processing temperature | Amount of replenishing |
|---|---|---|---|
| Color developing | 2 min 30 sec | 40° C. | 610 ml |
| Bleaching | 1 min | 38° C. | 460 ml |

-continued

| Processing Step | Processing Time | Processing temperature | Amount of replenishing |
|---|---|---|---|
| Bleach-fixing | 3 min | 38° C. | 920 ml |
| Stabilizing | 1 min | 35° C. | 800 ml |
| Drying | 1 min | 40–70° C. | — |

The amount of relenishing is indicated as a value per 1 $m^2$ of light-sensitive material.

Example 8

The following bleaching solution, bleaching replenishing solution, fixing solution and fixing replenishing solution were prepared.

| Bleaching solution | |
|---|---|
| Ferrio potassium 1,3-propylenediaminetetraacetate | 0.32 mol |
| Disodium ethylenediaminetetraacetate | 10 g |
| Potassium bromide | 100 g |
| Maleic acid | 30 g |
| Sodium nitrate | 40 g |
| Made up to 1 liter by adding water, and adjusted to pH 4.4 | |
| Bleaching replenishing solution | |
| Ferric potassium 1,3-propylenediaminetetraacetate | 0.35 mol |
| Disodium ethylenediaminetetraacetate | 2 g |
| Potassium bromide | 120 g |
| Maleic acid | 40 g |
| Sodium nitrate | 40 g |
| Made up to 1 liter by adding water, and adjusted to pH 3.4. | |
| Fixing solution and fixing replenishing solution | |
| Potassium thiocyanate | 120 g |
| Potassium thiosulfate | 200 g |
| Anhydrous sodium bisulfite | 20 g |
| Sodium metabisulfite | 4.0 g |
| Disodium ethylenediaminetetraacetate | 1.0 g |
| Made up to 1 liter by adding water, and adjusted to pH 6.5. | |

Stabilizing solution and stabilizing replenishing solution

The same as those used in Test Nos. 2-1 to 2-22 of Example 2.

Evaluation was made in the same manner as in Example 2 to obtain substantially the same results as in Example 2. Moreover the environment was in a good state free form the odor of ammonia or acetic acid. Furthermore, as an effect different from that in the present invention, the bleach fog (transmission densities of B, G and R) was as low as 0.01 to 0.03 and also the desilvering performance was good, because of use of no ammonia and acetic acid.

EXAMPLE 9

To the anti-haltion layer, the first layer of the light-sensitive silver halide color photographic material used in Example 2, the following compounds BAG-1 to -3 were added in an amount of 0.015 g each per 1 $m^2$ of the light-sensitive silver halide color photographic material, and evaluation was made in the same manner as in Example 2. As a result, intended results were seen in the desilvering performance and rate of discoloration, and the same results as in Example 2 were obtained in respect of other performances.

$AgSC_2H_4COOH$ BAG-1

-continued

BAG-2

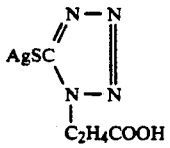

BAG-3

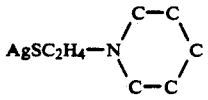

EXAMPLE 10

Evaluation was made in the same manner as in Example 1 except for using a stabilizing solution obtained by removing the antifungal agent 1,2-benzisothiazolin-3-one from the stabilizing solution used in Example 1, or using a stabilizing solution in which the 1,2-benzisothiazolin-3-one was replaced with benzotriazole and ortho-phenylphenol and water ion-exchanged using an ion-exchange resin (having both strong basicity and strong acidity) to contain 1.0 ppm of magnesium and 1.5 ppm of calcium. As a result, the days before occurrence of sulfiding became shorter by about 2 or 3 days because of the removal of the antifungal agent.

From this result, the antifungal agent proves necessary for improving the solution storage stability. The stabilizing solution making use of other antifungal agents and the ion-exchanged water showed substantially the same tendency as the stabilizing solution containing 1,2-benzisothiazolin-3-one.

Example 11

Using the light-sensitive material used in Example 2, evaluation was made in the same manner as in Example 2 except that the processing was carried out according to the following processing steps and using the following processing solutions.

| Processing Step | Processing Time | Processing temperature | Amount of replenishing |
|---|---|---|---|
| Color developing | 3 min 15 sec | 38° C. | 775 ml |
| Bleaching | 4 min 20 sec | 38° C. | 155 ml |
| Fixing | 4 min 20 sec | 38° C. | 500 ml |
| Washing | 3 min 15 sec | 18–42° C. | 75 lit. |
| Stabilizing | 2 min 10 sec | 38° C. | 775 ml |
| Drying | 1 min | 40–70° C. | — |

Color developing solution and color developing replenishing solution

The same as those used in Example 2.

| Bleaching solution | |
|---|---|
| Ferric ammonium 1,3-propylenediaminetetraacetate | 0.12 mol |
| 1,3-Propylenediaminetetraacetic acid | 5 g |
| Ammonium bromide | 100 g |
| Glacial acetic acid | 50 g |
| Ammonium nitrate | 40 g |
| Made up to 1 liter by adding water, and adjusted to pH 3.4 using ammonia water or glacial acetic acid. | |
| **Bleaching replenishing solution** | |
| Ferric ammonium 1,3-propylenediaminetetraacetate | 0.17 mol |
| 1,3-Propylenediaminetetraacetic acid | 7 g |
| Ammonium bromide | 142 g |
| Glacial acetic acid | 70 g |
| Ammonium nitrate | 57 g |
| Made up to 1 liter by adding water, and adjusted to pH 3.4 using ammonia water or glacial acetic acid. | |

-continued

| Fixing solution | |
|---|---|
| Ammonium thiosulfate | 140 g |
| Anhydrous sodium bisulfite | 20 g |
| Sodium metabisulfite | 40 g |
| Made up to 1 liter by adding water, and adjusted to pH 6.5 using glacial acetic acid and ammonia water. | |

As a result, the same results as in Example 2 were obtained in respect of the rate of discoloration, the yellow stain and the back-side deposits.

As having been described above, the present invention makes it possible to provide a stabilizing solution for light-sensitive silver halide color photographic materials that firstly can prevent discoloration of dyes in an environment of low humidity even when substantially no formaldehyde is contained in the stabilizing solution, secondly can better prevent back-side deposits on light-sensitive materials, thirdly have a superior storage stability and, in particular, can supply a processing solution wherein no sulfiding tends to occur, fourthly can better prevent yellow staining at non-image portions, and fifthly can improve the safety of work environments, and a processing method making use of such a stabilizing solution.

What is claimed is:

1. A stabilizing solution for a light-sensitive silver halide color photographic material which comprises 0.05 to 20 g per liter of a compound represented by the following Formula I, and a water soluble surface active agent in an amount sufficient to provide the stabilizing solution with a surface tension of from 15 to 60 dyne/cm at 20° C.;

Formula I:

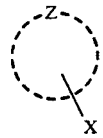

wherein Z represents a group of atoms necessary to form a substituted or unsubstituted cyclic hydrocarbon or heterocyclic ring, X represents an aldehyde group,

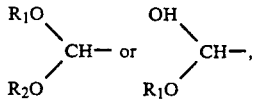

wherein $R_1$ and $R_2$ each represent a lower alkyl group; and wherein said cyclic hydrocarbon or heterocyclic ring is a benzene ring, a 5 or 6 membered heterocyclic ring, naphthalene, benzofuran, indol, thionaphthalene, benzaimidazole, benzotriazolyl or quinolyl.

2. The material of claim 1, wherein Z represents a group of atoms necessary to form said substituted cyclic hydrocarbon or heterocyclic ring.

3. The material of claim 1, wherein said stabilizing solution for a light-sensitive silver halide color photographic material comprises substantially no formaldehyde.

4. The material of claim 1, wherein said stabilizing solution for a light-sensitive silver halide color photographic material comprises a antifungal agent.

5. The material of claim 4, wherein said antifungal agent is a member selected from the group consisting of Formula B-1, B-2, and B-3, Formula B-1;

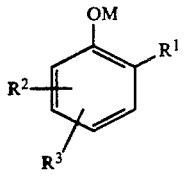

wherein $R_1$ represents an alkyl group, a cycloalkyl group, an aryl group, a hydroxy group, an alkoxycarbonyl group, an amino group, a carboxy group (including its salt) or a sulfo group (including its salt);

$R^2$ and $R^3$ independently represent a hydrogen atom, a halogen atom, an amino group, a nitro group, a hydroxy group, an alkoxycarbonyl group, a carboxy group (including its salt) or a sulfo group (including its salt), M represents a hydrogen atom, an alkali metal or an ammonium group;

Formula B-2

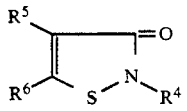

Formula B-3

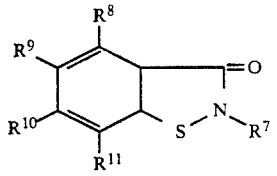

wherein $R^4$ represents a halogen atom, an alkyl group, an aryl group, a halogenated alkyl group, $—R^{12}—OR^{13}$, $—CONHR^{14}$ (where $R^{12}$ represents a alkylene group, $R_{13}$ and $R_{14}$ each represent a hydrogen atom, an alkyl group or an arylalkyl group) or an arylalkyl group; $R^5$ and $R^6$ each represent a hydrogen atom, a halogen atom, a halogenated alkyl group or alkyl group; $R_7$ represents a hydrogen atom, a halogen atom, an alkyl group, an aryl group, a halogenated alkyl group, an arylalkyl group, $—R^{15}—OR^{16}$, $—CONHR^{17}$ (where $R^{15}$ represents a alkylene group, $R_{16}$ and $R_{17}$ each represent a hydrogen atom, an alkyl group); and $R_8$, $R_9$, $R_{10}$ and $R_{11}$ each represent a hydrogen atom, a halogen atom, a hydroxy group, an alkyl group, an amino group or a nitro group.

6. The material of claim 1, wherein said compound represented by Formula I, is a member selected from the group consisting of No. 1 to No. 90 shown below, wherein the structural formulae of compounds No. 1 to No. 48 are each completed by inserting the following substituents or atoms 1 to 6 into the position 1 to 6 of the following formula:

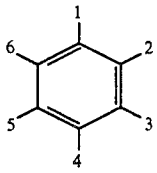

| No. | 1 | 2 | 3 | 4 | 5 | 6 |
|---|---|---|---|---|---|---|
| 1 | CHO | H | H | H | H | H |
| 2 | CHO | H | H | OH | H | H |
| 3 | CHO | H | OH | H | H | H |
| 4 | CHO | OH | H | H | H | H |
| 5 | CHO | OH | H | OH | H | H |
| 6 | CHO | H | OH | H | OH | H |
| 7 | CHO | OH | OH | H | H | H |
| 8 | CHO | H | CHO | H | OH | H |
| 9 | CHO | H | CHO | H | H | OH |
| 10 | CHO | OH | CHO | H | H | H |
| 11 | CHO | H | CHO | H | CHO | H |
| 12 | CHO | OH | CHO | H | CHO | H |
| 13 | $CH(OCH_3)_2$ | H | OH | H | H | H |
| 14 | $CH(OCH_3)_2$ | H | H | OH | H | H |
| 15 | $CH(OCH_3)_2$ | H | OH | H | OH | H |
| 16 | CHO | H | $NO_2$ | H | H | H |
| 17 | CHO | H | H | $NO_2$ | H | H |
| 18 | CHO | $NO_2$ | H | H | H | H |
| 19 | CHO | H | $NO_2$ | H | $NO_2$ | H |
| 20 | CHO | H | H | $OCH_3$ | H | H |
| 21 | CHO | H | $OCH_3$ | H | OH | H |
| 22 | CHO | H | OH | $OCH_3$ | H | H |
| 23 | CHO | H | $OCH_3$ | OH | H | H |
| 24 | CHO | H | OH | $OCH_3$ | OH | H |
| 25 | CHO | H | Cl | H | H | H |
| 26 | CHO | H | H | Cl | H | H |
| 27 | CHO | H | Cl | H | Cl | H |
| 28 | CHO | H | COOH | COOH | H | H |
| 29 | CHO | H | Br | H | H | H |
| 30 | CHO | H | H | Br | H | H |
| 31 | CHO | H | OH | $SO_3H$ | H | H |
| 32 | CHO | H | H | $NH_2$ | H | H |
| 33 | CHO | H | H | $N(CH_3)_2$ | H | H |
| 34 | CHO | H | H | $N(C_2H_6)_2$ | H | H |
| 35 | CHO | H | H | $CONH_2$ | H | H |
| 36 | CHO | H | H | $SO_2NH_2$ | H | H |
| 37 | CHO | H | H | $SO_3H$ | H | H |
| 38 | CHO | H | H | CN | H | H |
| 39 | CHO | H | H | $COOCH_3$ | H | H |
| 40 | CHO | H | H | COOH | H | H |
| 41 | CHO | H | $SO_3H$ | H | H | H |
| 42 | CHO | H | COOH | H | H | H |
| 43 | CHO | H | CN | H | H | H |
| 44 | CHO | H | $COOCH_3$ | H | H | H |
| 45 | CHO | H | $CONH_2$ | H | H | H |
| 46 | $CH(OH)(OCH_3)$ | H | OH | H | H | H |
| 47 | $CH(OH)(OCH_3)$ | H | H | OH | H | H |
| 48 | CHO | H | OH | $CH_3$ | H | H |

49 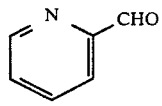

50 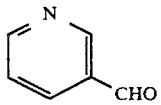

51 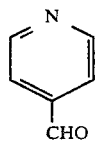

52 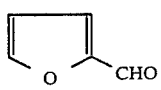

-continued

53 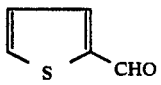

54 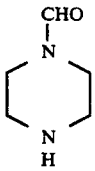

55 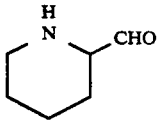

56 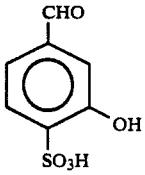

57 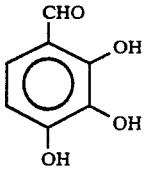

58 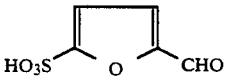

59 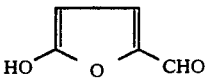

60 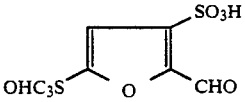

61 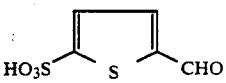

62 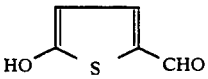

63 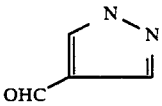

64 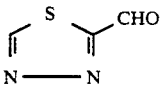

65 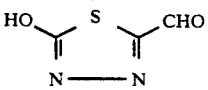

66 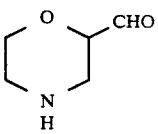

67 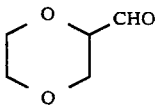

68 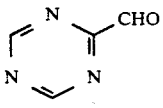

69 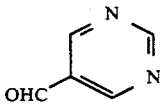

70 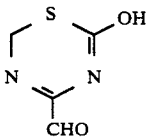

71 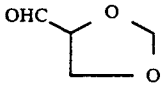

72 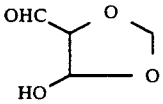

73 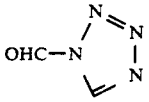

74 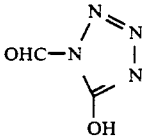

-continued

75 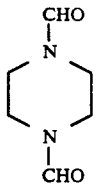

76 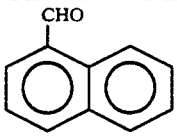

77 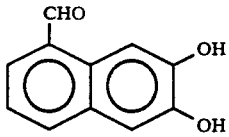

78 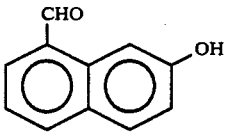

79 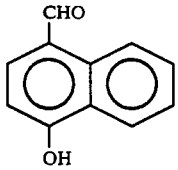

80 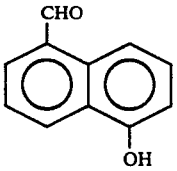

81 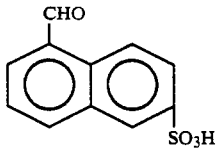

82 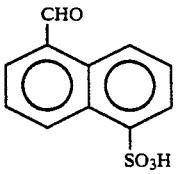

83 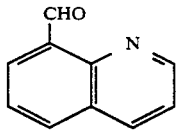

84 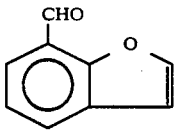

85 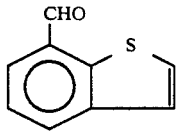

86 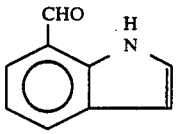

87 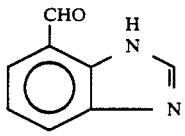

88 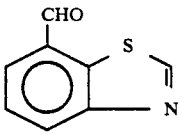

89 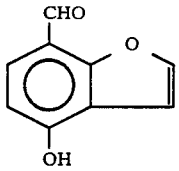

90 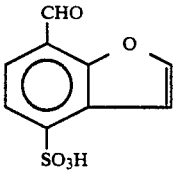

7. The material of claim 1, wherein said water-soluble surface active agent is a member selected from the group consisting of Formula SI, SII, and SU-I;

$$R^1—X—(E^1)_{11}—(E^2)_{m1}—(E^3)_{n1}—R^2 \qquad \text{Formula SI}$$

wherein $R^1$ represents a hydrogen atom, an aliphatic group or an acyl group, $R^2$ represents a hydrogen atom or an aliphatic group, $E^1$ represents an ethylene oxide group, $E^2$ represents a propylene oxide group, $E^3$ represents an ethylene oxide group, X represents an oxygen atom or an $—R^3N—$ group, wherein $R^3$ represents an aliphatic group, a hydrogen atom or $(E^1)_{12}—(E^2)$-

$_{m2}$—$(E^3)_{n2}$—$R^4$, wherein $R^4$ represents a hydrogen atom or an aliphatic group, $l_1$, $l_2$, $m_1$, $m_2$, $n_1$, $n_2$ each represents a value of 0 to 300;

$$A_2—O—(B)_m—(C)_n—X^1 \qquad \text{Formula SII}$$

wherein $A_2$ represents a monovalent organic group as exemplified by an alkyl group having 6 to 50 carbon atoms, B and C represents each an ethylene oxide group, a propylene oxide group, or $$—(CH_2)_{n1}—\underset{\underset{OH}{|}}{(CH)}_{m1}—(CH_2)_{l1}—O—,$$

wherein n1, m1 and 11 each represents 0, 1, 2 or 3, m and n each represents an integer of 0 to 100, $X^1$ represents a hydrogen atom, or an alkyl group, an aralkyl group or an aryl group, Formula SU-I:

$$CH_3—\underset{\underset{CH_3}{|}}{\overset{\overset{CH_3}{|}}{Si}}—O—(\underset{\underset{CH_3}{|}}{\overset{\overset{CH_3}{|}}{Si}}—O)_{l1}—(\underset{\underset{(CH_2)_p—(O—X_1)_{q1}—(O—X_2)_{q2}—R_9}{|}}{\overset{\overset{CH_3}{|}}{Si}}—O)_{l2}—(\underset{\underset{CH_3}{|}}{\overset{\overset{CH_3}{|}}{Si}}—O)_{l3}—CH_3$$

wherein $R_9$ represents a hydrogen atom, a hydroxy group, a lower alkyl group, an alkoxy group,

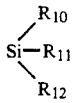

or

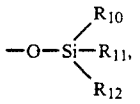

wherein $R_{10}$, $R_{11}$ and $R_{12}$ each represents a hydrogen atom or a lower alkyl group, and $R_{10}$, $R_{11}$ and $R_{12}$ are the same or different from each other, $l_1$ to $l_3$ each represents an integer of 0 or 1 to 30, p, q1 and q2 each represents an integer of 0 or 1 to 30, $X_1$ and $X_2$ each represent —$CH_2CH_2$—, —$CH_2CH_2CH_2$—, $$—CH_2—\underset{\underset{CH_3}{|}}{CH}—$$

or $$—\underset{\underset{CH_3}{|}}{CH}—CH_2—.$$

8. The stabilizing solution of claim 1, wherein the compound of Formula I is present in an amount of 0.1 to 15 grams per liter.

9. The stabilizing solution of claim 1, wherein the compound of Formula I is present in an amount of 0.1 to 10 grams per liter.

10. The stabilizing solution of claim 1, wherein the surface tension is 15 to 45 dyne/cm at 20° C.

11. The stabilizing solution of claim 6, wherein the surface tension is 15 to 45 dyne/cm at 20° C.

12. A stabilizing solution for a light-sensitive silver halide color photographic material, which comprises a compound selected from the group consisting of the following No. 1 to 90, a water soluble surface active agent and substantially no formaldehyde; and has a surface tension of from 15 to 45 dyne/cm at 20° C.

wherein the structural formulae of Exemplary compounds No. 1 to No. 48 are each completed by inserting the following substituents or atoms 1 to 6 to the position 1 to 6 of the following formula:

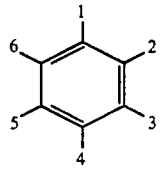

| No. | 1 | 2 | 3 | 4 | 5 | 6 |
|---|---|---|---|---|---|---|
| 1 | CHO | H | H | H | H | H |
| 2 | CHO | H | H | OH | H | H |
| 3 | CHO | H | OH | H | H | H |
| 4 | CHO | OH | H | H | H | H |
| 5 | CHO | OH | H | OH | H | H |
| 6 | CHO | H | OH | H | OH | H |
| 7 | CHO | OH | OH | H | H | H |
| 8 | CHO | H | CHO | H | OH | H |
| 9 | CHO | H | CHO | H | H | OH |
| 10 | CHO | OH | CHO | H | H | H |
| 11 | CHO | H | CHO | H | CHO | H |
| 12 | CHO | OH | CHO | H | CHO | H |
| 13 | $CH(OCH_3)_2$ | H | OH | H | H | H |
| 14 | $CH(OCH_3)_2$ | H | H | OH | H | H |
| 15 | $CH(OCH_3)_2$ | H | OH | H | OH | H |
| 16 | CHO | H | $NO_2$ | H | H | H |
| 17 | CHO | H | H | $NO_2$ | H | H |
| 18 | CHO | $NO_2$ | H | H | H | H |
| 19 | CHO | H | $NO_2$ | H | $NO_2$ | H |
| 20 | CHO | H | H | $OCH_3$ | H | H |
| 21 | CHO | H | $OCH_3$ | H | OH | H |
| 22 | CHO | H | OH | $OCH_3$ | H | H |
| 23 | CHO | H | $OCH_3$ | OH | H | H |
| 24 | CHO | H | OH | $OCH_3$ | OH | H |
| 25 | CHO | H | Cl | H | H | H |
| 26 | CHO | H | H | Cl | H | H |
| 27 | CHO | H | Cl | H | Cl | H |
| 28 | CHO | H | COOH | COOH | H | H |
| 29 | CHO | H | Br | H | H | H |
| 30 | CHO | H | H | Br | H | H |
| 31 | CHO | H | OH | $SO_3H$ | H | H |
| 32 | CHO | H | H | $NH_2$ | H | H |
| 33 | CHO | H | H | $N(CH_3)_2$ | H | H |
| 34 | CHO | H | H | $N(C_2H_6)_2$ | H | H |
| 35 | CHO | H | H | $CONH_2$ | H | H |
| 36 | CHO | H | H | $SO_2NH_2$ | H | H |
| 37 | CHO | H | H | $SO_3H$ | H | H |
| 38 | CHO | H | H | CN | H | H |
| 39 | CHO | H | H | $COOCH_3$ | H | H |
| 40 | CHO | H | H | COOH | H | H |
| 41 | CHO | H | $SO_3H$ | H | H | H |
| 42 | CHO | H | COOH | H | H | H |
| 43 | CHO | H | CN | H | H | H |
| 44 | CHO | H | $COOCH_3$ | H | H | H |
| 45 | CHO | H | $CONH_2$ | H | H | H |
| 46 | $CH(OH)(OCH_3)$ | H | OH | H | H | H |
| 47 | $CH(OH)(OCH_3)$ | H | H | OH | H | H |
| 48 | CHO | H | OH | $CH_3$ | H | H |

-continued
49 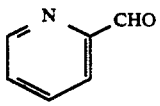
50 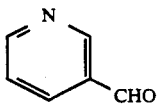
51 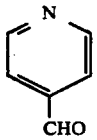
52 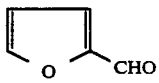
53 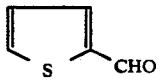
54 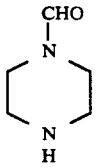
55 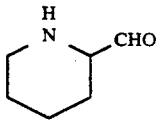
56 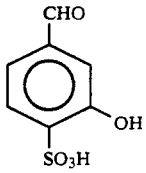
57 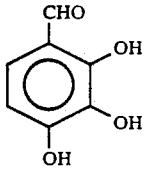
58 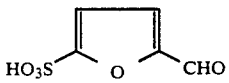
59 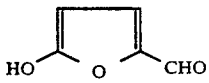
60 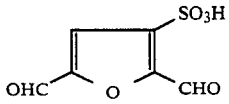
61 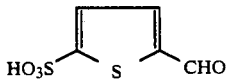
62 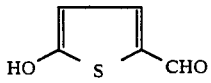
63 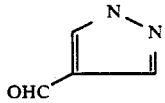
64 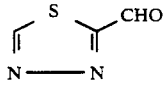
65 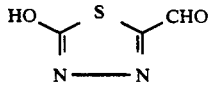
66 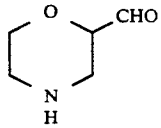
67 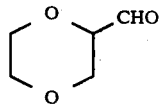
68 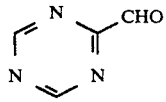
69 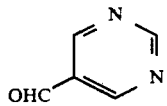
70 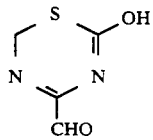
71 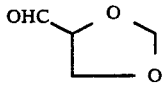
72 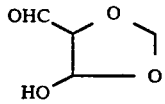
73 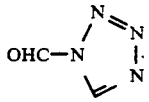
74 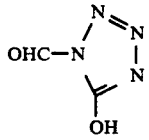
75 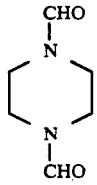
76 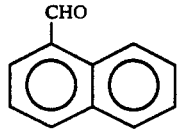
77 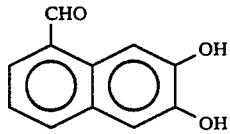
78 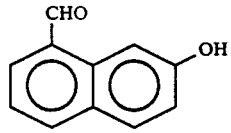
79 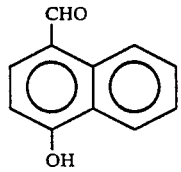
80 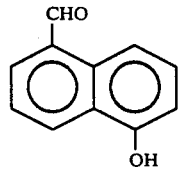
81 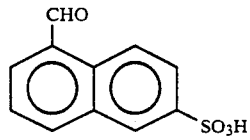
82 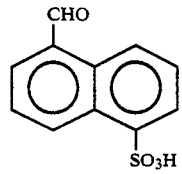
83 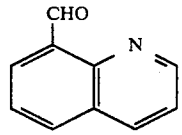
84 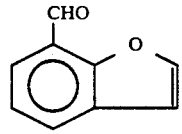
85 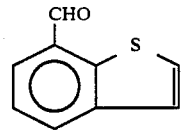
86 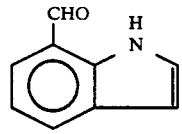
87 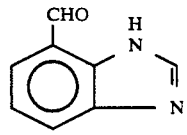
88 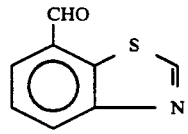
89 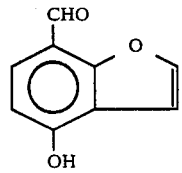
90 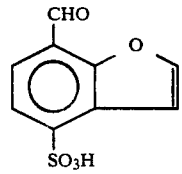
* * * * *